US008984913B2

(12) United States Patent
Park et al.

(10) Patent No.: US 8,984,913 B2
(45) Date of Patent: Mar. 24, 2015

(54) CLEANING APPARATUS AND MANUFACTURING AND ASSEMBLY METHODS FOR THE SAME

(75) Inventors: Hye-yong Park, Changwon-si (KR); Bo Yeon Kim, Kyungsangnam-do (KR); Dae Hee Kwon, Busan-si (KR); Hyun Seok Kim, Seoul (KR); Seong Yeol Lee, Daegoo-si (KR); Myong Deok Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1747 days.

(21) Appl. No.: 11/918,369

(22) PCT Filed: Apr. 13, 2006

(86) PCT No.: PCT/KR2006/001374
§ 371 (c)(1),
(2), (4) Date: Oct. 30, 2008

(87) PCT Pub. No.: WO2006/110006
PCT Pub. Date: Oct. 19, 2006

(65) Prior Publication Data

US 2009/0066205 A1 Mar. 12, 2009

(30) Foreign Application Priority Data

| | | |
|---|---|---|
| Apr. 15, 2005 | (KR) | 10-2005-0031475 |
| Apr. 15, 2005 | (KR) | 10-2005-0031477 |
| Apr. 15, 2005 | (KR) | 20-2005-0010492 U |
| Apr. 15, 2005 | (KR) | 20-2005-0010493 U |
| Apr. 25, 2005 | (KR) | 10-2005-0034248 |
| Apr. 25, 2005 | (KR) | 10-2005-0034250 |
| Apr. 28, 2005 | (KR) | 10-2005-0035750 |
| Apr. 28, 2005 | (KR) | 10-2005-0035761 |
| Apr. 28, 2005 | (KR) | 10-2005-0035763 |

(51) Int. Cl.
*D06F 39/12* (2006.01)
*D06F 39/14* (2006.01)
(Continued)

(52) U.S. Cl.
CPC ..... *D06F 39/12* (2013.01); *D06F 39/14* (2013.01); *D06F 39/005* (2013.01); *A47L 15/4251* (2013.01); *A47L 15/4293* (2013.01)
USPC ..... 68/3 R; 312/228

(58) Field of Classification Search
CPC ..... D06F 39/12; D06F 39/14; D06F 39/005
USPC ..... 68/3 R, 4, 13 R; 312/228, 265.5–265.6, 312/204; 134/56 R, 57 R, 58 R
See application file for complete search history.

(56) References Cited

U.S. PATENT DOCUMENTS 3,253,874 A * 5/1966 Czech ..... 312/265.5
4,359,250 A * 11/1982 Jenkins ..... 312/228
(Continued)

FOREIGN PATENT DOCUMENTS

DE 4327916 2/1994
EP 0588100 A1 3/1994
(Continued)

OTHER PUBLICATIONS

BASF News Releases on Terluran® GP-35 (http://www2.basf.de)(Feb. 21, 2006)(http://web.archive.org/web/20060221004954/http://www2.basf.de/basf2/html/plastics/englisch/pages/pressed/04_372.htm).*
(Continued)

*Primary Examiner* — Joseph L Perrin
*Assistant Examiner* — Kevin G Lee
(74) *Attorney, Agent, or Firm* — McKenna, Long & Aldridge LLP

(57) ABSTRACT

A cleaning apparatus is provided. The cleaning apparatus includes a cabinet (2), front panel (4), control panel (8), and fringe frame (5). The cabinet (2) is opened at a surface thereof. The front panel (4) is installed on a side of the cabinet (2), and includes a cabinet cover (42) forming a laundry inserting hole and an outer cover (41) coupled to a front surface of the cabinet cover (42) and color treated on its front surface through painting. The control panel (8) is mounted on top of the front panel (4). The fringe frame (5) covers the edge portion of the front panel (4) and the control panel (8).

12 Claims, 19 Drawing Sheets

(51) Int. Cl.
*D06F 39/00* (2006.01)
*A47L 15/42* (2006.01)

(56) References Cited

U.S. PATENT DOCUMENTS

| | | | | | |
|---|---|---|---|---|---|
| 4,732,431 | A | * | 3/1988 | Mason | 312/109 |
| 5,806,942 | A | * | 9/1998 | Jenkins et al. | 312/204 |
| 2004/0045150 | A1 | * | 3/2004 | Fitton et al. | 29/428 |

FOREIGN PATENT DOCUMENTS

| | | | | |
|---|---|---|---|---|
| GB | 2 022 621 | A | | 12/1979 |
| GB | 2022621 | A | * | 12/1979 |
| GB | 2 071 706 | | | 9/1981 |
| GB | 2 071 706 | A | | 9/1981 |
| GB | 2071706 | A | * | 9/1981 |
| JP | 61168672 | A | * | 7/1986 |
| JP | 11-062410 | | | 3/1999 |
| JP | 2001-269498 | A | | 10/2001 |
| JP | 2001269498 | A | * | 10/2001 |
| JP | 2003-024689 | A1 | | 1/2003 |
| JP | 2004-362508 | | | 12/2004 |
| KR | 10-1999-0065527 | A | | 1/1998 |
| KR | 10-1999-0034622 | | | 8/1999 |
| KR | 10-2000-0033336 | | | 6/2000 |
| KR | 10-2002-0054278 | | | 7/2002 |
| KR | 10-2003-0011457 | | | 2/2003 |
| KR | 10-2004-0006237 | | | 1/2004 |
| KR | 10-2004-0046916 | | | 6/2004 |
| KR | 10-2004-0046978 | A | | 6/2004 |
| SU | 1746429 | | | 8/1992 |

OTHER PUBLICATIONS

Machine translation of EP 0588100 A1, dated Mar. 23, 1994.*

* cited by examiner

CLEANING APPARATUS AND MANUFACTURING AND ASSEMBLY METHODS FOR THE SAME

This application claims the benefit of PCT/KR2006/001374, filed on Apr. 13, 2006, and claims priority to Korean Application Nos. 20-2005-10492, 20-2005-10493, 10-2005-31475, 10-2005-31477, each filed on Apr. 15, 2005, Korean Application Nos. 10-2005-34248, 10-2005-34250, each filed on Apr. 25, 2005, and Korean Application Nos. 10-2005-35761, 10-2005-35750, 10-2005-35763, each filed on Apr. 28, 2005, all of which are hereby incorporated herein by reference in their entireties.

TECHNICAL FIELD

The present invention relates to a cleaning apparatus, and more particularly, to an easily interchangeable structure for a front portion of a cleaning apparatus that enables the use of a variety of colors to decorate the front portion according to a user's preferences, and to manufacturing and assembly methods for the same.

BACKGROUND ART

Cleaning apparatuses generally include washing machines with a washing function for washing stains and dirt from laundry and dryers that have a drying function for drying wet laundry.

In more detail, a washing machine has a cylindrical washing compartment, in which laundry in placed, after which the compartment is rotated to agitate the laundry in water with detergent dissolved in it, in order to remove impurities from the laundry. Washing machines can largely be divided into two categories: pulsator-type washing machines (with vertically-installed wash compartments and a pulsator installed at the bottom), and drum-type washing machines (with horizontally-installed washing compartments that wash laundry by raising and dropping it through rotation).

Dryers for drying laundry blow hot air inside to evaporate moisture within the laundry.

Drum-type cleaning apparatuses according to the related art generally include a drum for holding laundry, a tub (not applicable to dryers) disposed within the drum for storing wash liquid, a cabinet for enclosing and protecting the drum or tub and forming the exterior of the apparatus, a motor for driving the drum, and a front portion installed on the front of the cabinet. The front portion has a control panel with various buttons, a door for opening and closing a portal to insert and extract laundry, and a front panel installed to allow the door to pivot and to cover the front portion of the cabinet.

Here, in the case of cleaning apparatuses according to the related art, the front portion is given a permanent color when the product is manufactured. That is, the front portion is painted in the same color as the cabinet. In order to replace the front panel, the entire apparatus must be disassembled or replaced.

Also, in washing machines or dryers according to the related art, the front panel is formed of a metal material, and is thus expensive to replace and puts a financial burden on the consumer.

Additionally, in cleaning apparatuses according to the related art, the control panel and the cabinet cover may be scratched, dented, or otherwise damaged during transport or use of the cleaning apparatus, so that the finish of the front portion is diminished. Also, after a long period of use, a user may grow tired of the color of the front of the cleaning apparatus.

DISCLOSURE OF INVENTION

Technical Problem

To solve the above problem, the present invention provides a cleaning apparatus that allows a consumer to easily change the color of the front portion of the apparatus (whether it be a washing machine, dryer, or other cleaning apparatus), and manufacturing and assembly methods for the cleaning apparatus.

Another object of the present invention is to provide a cleaning apparatus that can satisfy a variety of consumer tastes by allowing the front portion thereof to be replaced with a variety of colors, patterns, or designs without changing the other parts of the product's exterior in the manufacturing process. The present invention is especially applicable to built-in cleaning apparatuses that only have their front portions exposed to the outside.

A further object of the present invention is to provide a cleaning apparatus that allows only a section of its outer perimeter that is damaged during transport or assembly to be replaced without having to replace the entire outer portion, in order to facilitate repairs and reduce repair costs.

A still further object of the present invention is to provide a cleaning apparatus that allows easy assembly of its front portion, and an assembling method of the front portion of the cleaning apparatus.

Technical Solution

According to an aspect of the present invention, there is provided a cleaning apparatus including: a cabinet opened at a surface thereof; a front panel installed on a side of the cabinet, and including a cabinet cover forming a laundry inserting hole and an outer cover coupled to a front surface of the cabinet cover; a control panel coupled to the front panel; and a fringe frame covering at least one edge portion of the front panel and the control panel.

According to another aspect of the present invention, there is provided a cleaning apparatus including: a drum; a cabinet having the drum within and being opened at one side thereof; a cabinet cover coupled at a front of the cabinet, and made of a metal material that forms a hole within for inserting laundry; an outer cover coupled to the cabinet cover, and made of a non-metal that forms a hole within for inserting laundry; and a fringe panel formed at a front perimeter of the cabinet.

According to still another aspect of the present invention, there is provided a cleaning apparatus including: a cabinet forming an exterior thereof; a cabinet cover mounted on a front of the cabinet; an outer cover coupled to a front surface of the cabinet cover and made of a heat resistant plastic having a slippery surface due to being made using a superfinished mold; a fringe frame including a side frame covering side surfaces of the cabinet and outer covers, a lower frame mounted at bottoms of the cabinet and outer covers, and an upper frame mounted on a top of the side frame; and a control panel coupled to the cover, and protected on a perimeter thereof by the upper frame.

According to a yet another aspect of the present invention, there is provided a cleaning apparatus including: a cabinet opened at a side thereof; an upper panel coupled at a top of the opened side; a lower panel coupled at a bottom of the opened side; a cover member including a cabinet cover with an upper end and a lower end respectively coupled to the upper panel and the lower panel, and an outer cover coupled to a front surface of the cabinet cover; a control panel mounted on a top of the cover member; and a fringe frame including a side frame installed on a side surface of the cover member, a lower frame installed at a bottom of the cover member, and an upper frame surrounding a perimeter of the control panel.

According to a further aspect of the present invention, there is provided a cleaning apparatus including: a cabinet; a front panel including a cabinet cover coupled at a front surface of the cabinet and an outer cover coupled at a front surface of the cabinet cover and capable of being painted to provide a visually pleasing exterior of the cleaning apparatus; and a door pivotably coupled to the front panel.

According to a still further aspect of the present invention, there is provided a manufacturing method for a cleaning apparatus including: manufacturing a cabinet cover with a hole for inserting laundry using press manufacturing and forming manufacturing for reinforcement; injection molding an outer cover with paintable ABS material that does not corrode when painted; spraying a paint of a predetermined color onto a front surface of the outer cover; drying the painted outer cover at a predetermined temperature for a predetermined duration; and installing the outer cover on a front surface of the cabinet cover.

According to an even further aspect of the present invention, there is provided an assembly method of a cleaning apparatus including: coupling an upper panel and a lower panel to a cabinet; performing a front panel assembly by coupling an outer cover to a front of a cabinet cover; coupling a fringe frame to a edge portion of the front panel; coupling the front panel to the cabinet; and mounting a control panel on an upper portion of the front panel.

According to an additional aspect of the present invention, there is provided an assembly method of a cleaning apparatus including: coupling an outer cover to a front surface of a cabinet cover; coupling a side frame to side surfaces of the cabinet cover and the outer cover; coupling a lower frame to bottom surfaces of the cabinet cover and the outer cover; coupling the cabinet cover to a cabinet; coupling an upper frame to the side frame and the cabinet; and inserting a control panel in an inner space of the upper frame.

Advantageous Effects

An advantage of the cleaning apparatus and the manufacturing and assembly methods thereof according to the present invention is that it allows a consumer to conveniently change the color of the front portion of a washing machine, dryer, or other cleaning apparatus.

Another advantage of the cleaning apparatus and the manufacturing and assembly methods thereof according to the present invention is that it allows a variety of consumer tastes to be satisfied by changing only the front portion of the cleaning apparatus to different colors, patterns, or designs, without having to change the entire exterior.

A further advantage of the cleaning apparatus and the manufacturing and assembly methods thereof according to the present invention is that it allows replacement of only the section of the cleaning apparatus' outer perimeter that is damaged during transport or assembly without having to replace the entire outer portion, in order to facilitate repairs and reduce repair costs.

A still further object of the present invention is to provide a cleaning apparatus with a highly-finished edge portion for a high quality look and high value-added.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

To explain the cleaning apparatus according to the present invention, a drum washing machine will be used as a representative example. Here, the present invention covers not only drum washing machines, but also dryers for drying laundry, and even dishwashers.

Figure 1:
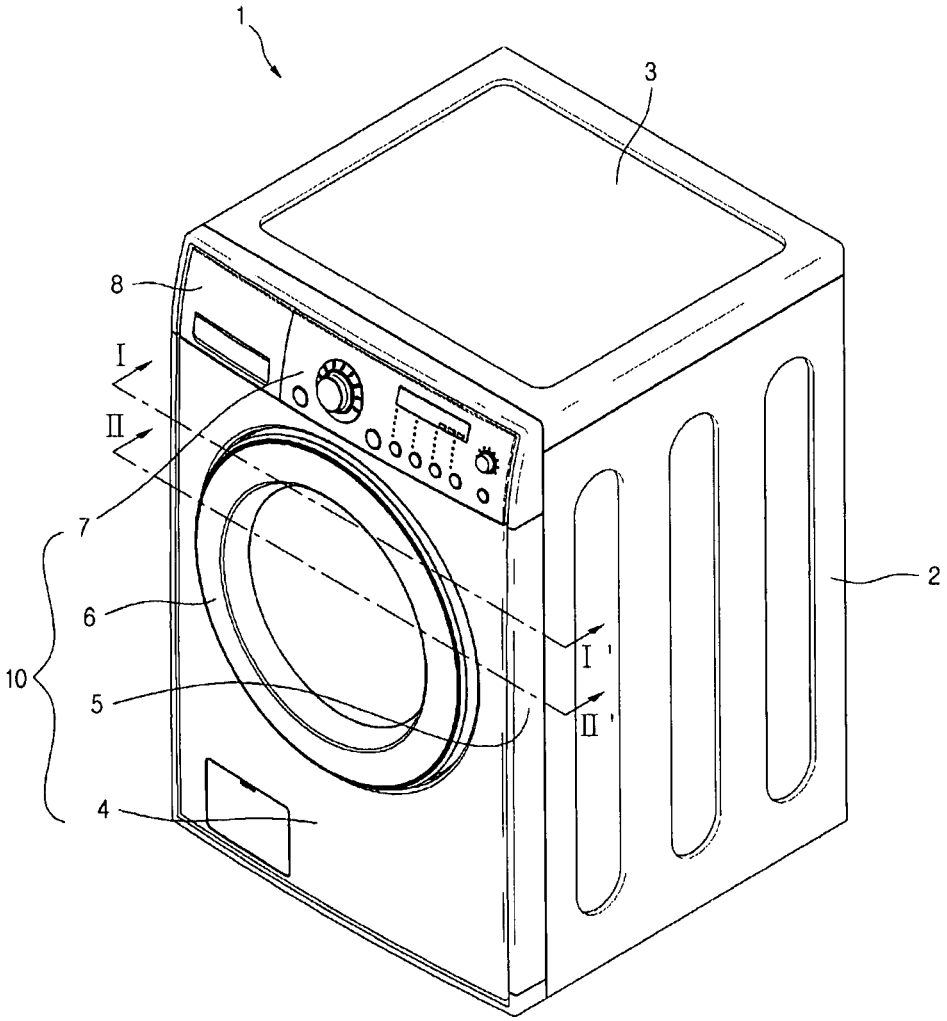
FIG. 1 is a perspective view of a cleaning apparatus according to the present invention.

FIG. 1 is a perspective view of a cleaning apparatus according to the present invention.

In the first embodiment, a drum washing machine will be used as a representative example of cleaning apparatuses to which the present invention applies.

Referring to FIG. 1, a drum washing machine 1 having a front portion according to the present invention includes a cabinet 2 forming the exterior of the product with an opened front end, a top cover 3 covering the top surface of the cabinet, and a front unit 10 installed on the open front portion of the cabinet 2.

In more detail, the front unit 10 includes a front panel 4, a door 6 pivotably installed at the approximate center of the front panel 4 for inserting and extracting laundry, a control panel 7 mounted above the front panel 4 (and having various buttons for inputting wash settings, a power button, etc.), and a fringe frame 5 covering the outer perimeter of the front panel 4 and the control panel 7. Also, a detergent box 8 is installed on a side of the control panel 7 for putting detergent in. A drum for receiving laundry and a tub for enclosing the exterior of the drum are installed inside the cabinet 2. A drive motor is installed behind the drum for spinning the drum during the wash course.

To describe the operation of the above-structured drum washing machine, a user first opens the door 6, inserts laundry into the drum, and closes the door 6. Then, detergent is put into the detergent box 8, after which wash commands are inputted and the start button is pressed. Wash water then flows through the detergent box to mix with the detergent therein, and enters the inside of the drum. When a preset amount of wash liquid (the mixture of water and detergent) fills the drum, the water supply is closed and the drum begins to rotate, starting the wash cycle. When the wash cycle is completed, a rinse cycle, and then a spin cycle are carried out to complete the wash course.

Below, a more detailed description of the front unit 10 of the cleaning apparatus 1 will be provided.

Figure 2:
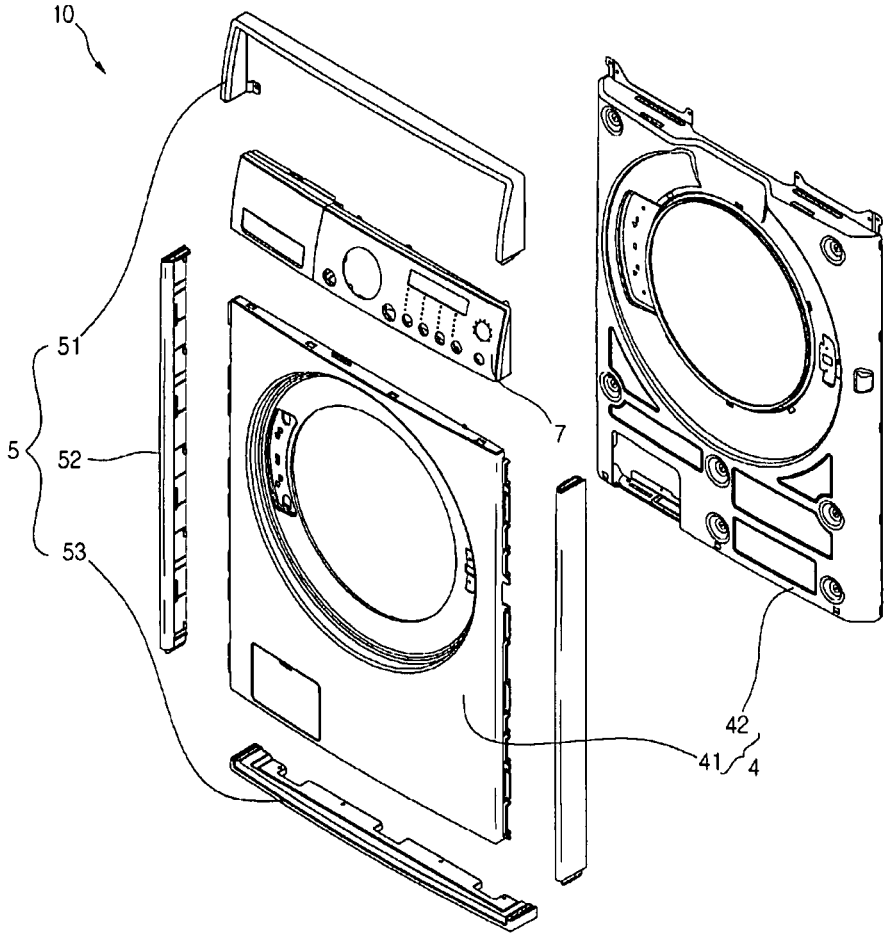
FIG. 2 is an exploded perspective view of a front portion of a cleaning apparatus according to the present invention.

FIG. 2 is an exploded perspective view of a front portion of a cleaning apparatus according to the present invention.

Referring to FIG. 2, the front unit 10 mounted to the cabinet 2 of the cleaning apparatus 1 according to the present invention includes a rectangularly shaped front panel 4 covering the open front surface of the cabinet 2, a control panel 7 mounted above the front panel 4, and a fringe frame 5 enclosing the edges of the front panel 4 and the control panel 7.

In further detail, the front panel 4 includes a cabinet cover 42 whose rear perimeter is installed on the front perimeter of the cabinet 2, and an outer cover 41 installed on the front of the cabinet cover 42 and forming the exterior of the cleaning apparatus 1. The rear perimeter of the cabinet cover 42 is installed on fastening members on the front perimeter of the cabinet 2, so that the cabinet cover 42 functions as a structural reinforcing agent for retaining the shape of the cabinet 2 to prevent denting thereof.

Here, when the cabinet 2 is open at its rear and has the front panel 4 installed at its front, the cabinet cover 42 is integrally connected with either side of the cabinet 2, so that a separate cabinet cover member does not need to be mounted. In other words, only the outer cover 41 may be mounted on the front surface of the cabinet 2.

The outer cover 41, as a plastic injection molded cover applied with a predetermined color, functions as an interior plate for decorating the front exterior of the cleaning apparatus 1. The outer cover 41 may also easily be removed from the cabinet cover 42 and freely interchanged with a color that a user prefers. Also, the outer cover 41 is formed through plastic injection molding, so that its material cost is less than that of the cabinet cover 42. Thus, replacement of the outer cover 41 is not expensive.

The fringe frame 5 includes a lower frame 53 installed at the lower end of the front panel 4, a side frame 52 installed on either side of the front panel 5, and an upper frame 51 installed on the upper edge portion of the control panel 7.

Specifically, the fringe frame 5 may be made in 4 separate components to surround the front panel 4 and the control panel 7, as described above, or in two parts, where the side panels 52 are integrally formed with the lower panel 7 to form a 'u' shape. In addition, the upper frame 51, side frames 52, and lower frame 53 may be integrally formed to create a rectangular overall shape. In other words, the shape and number of pieces forming the fringe frame 5 are not limited to those in the present embodiment, and may adopt various forms and have different numbers of assembled pieces, which falls within the scope of the present invention.

Here, the fringe frame 5 is installed around the outer edges of the front panel 4 and the control panel 7, so that the contacting region between the cabinet cover 42 and the outer cover 41 (at the outer edges thereof) is concealed. Therefore, the front unit 10 has an edge that is clean and has a high-quality finish, due to the fringe frame 5.

The assembly method and process for the various components which compose the front unit 10 will now be described in detail with reference to the diagrams.

Figure 3:
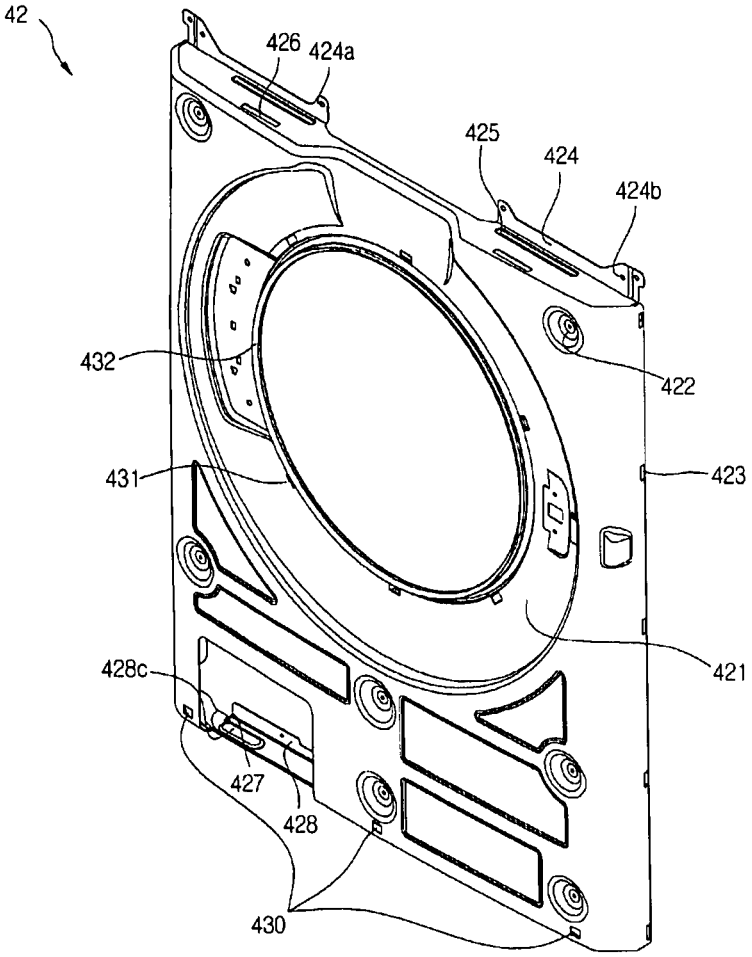
FIG. 3 is a frontal perspective view of a cabinet cover of a front portion of a cleaning apparatus according to the present invention.
Figure 4:
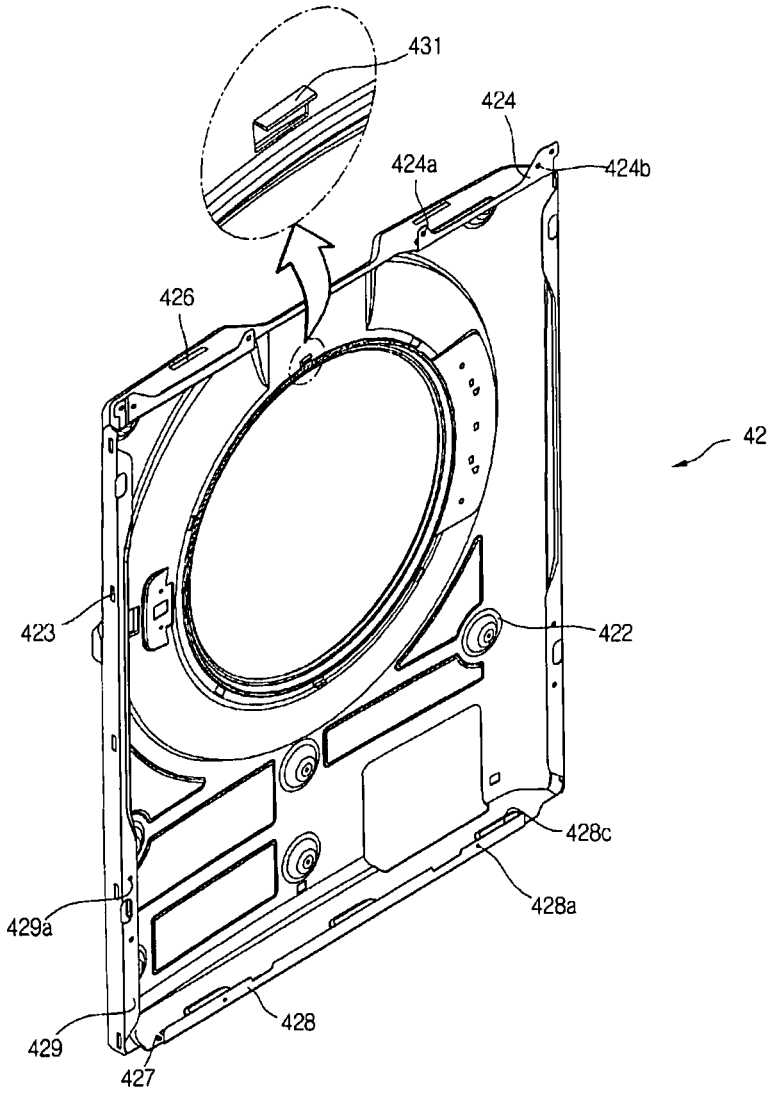
FIG. 4 is a rear perspective view of the cabinet cover in FIG. 3.

FIG. 3 is a frontal perspective view of a cabinet cover of a front portion of a cleaning apparatus according to the present invention, and FIG. 4 is a rear perspective view of the cabinet cover in FIG. 3.

Referring to FIGS. 3 and 4, a cabinet cover 42 according to the present invention is installed on the exposed front surface of the cabinet 2, as described above.

In detail, the cabinet cover 42 has its four side edges bent or curved rearward and bent again at an angle of approximately 90° to form a guide rib. The guide rib includes an upper guide rib 424 bent upwards from the top end of the cabinet cover 42, a side guide rib 429 bent inwards from either side edge of the cabinet cover 42, and a lower guide rib 428 formed on the lower surface of the cabinet cover 42 and bent upwards therefrom. A bolting hole 424*a* is formed in the upper guide rib 424 for inserting a fastening member through. The fastening member that inserts through the bolting hole 424*a* firmly fastens the cabinet cover 42 to the cabinet 2. Also, bolting holes 429*a* and 428*a* are respectively formed in the side guide rib 429 and the lower guide rib 428 to insert fastening members through.

The end portions on either side of the upper guide rib 424 have upper frame fastening holes 424*b* formed therein. Specifically, a fastening member that inserts through the upper frame fastening hole 424*b* simultaneously couples the cabinet cover 42 to the upper frame 51 and the cabinet 2. A detailed description is provided below.

Moreover, the control panel 7 is mounted on the curved surface at the top of the cabinet cover 42, and the side frame 52 is installed on the bent surfaces on either side thereof. The lower frame 52 is coupled to the bent surface at the lower end of the cabinet cover 42. A hook insert hole 423 is formed in the curved surfaces on either side of the cabinet cover 42 for inserting a hook formed on the side frame 52. An upper rib insert hole 426 is formed in the curved surface at the top of the cabinet cover 42 for inserting a coupling rib 416 (in FIG. 6) formed on the upper portion of the outer cover 41. The upper rib insert hole 426 may be formed symmetrically on either side of a line dividing the cabinet cover 42 vertically in two. A drain hole 425 is formed at a position a predetermined distance to the rear of the upper rib insert hole 426. Accordingly, even if water vapor enters the front unit 10 and condenses during a wash cycle, it can flow into the cabinet 2 through the drain hole 425, preventing it from entering the door hinge mechanism or the door switch.

A door mount 421 is formed to recess a predetermined distance and width into the front surface of the cabinet cover 42. The door mount 421 is located where the door is, is shaped in a round shape reflecting that of the door, and forms an open hole through the middle for inserting and extracting laundry through. The edge of the open hole is bent forward, and the end of the bent section is bent again radially to form a gasket mounting rib 432. The shape of the gasket mounting rib 432 can be readily seen in FIG. 18. In detail, the gasket mounting rib 432 is formed as shown, so that a gasket may be inserted in the outer perimeter thereof so that the gasket does not fall out.

A plurality of center hook insert holes 431 are formed at a predetermined interval around the inner circumference of the door mount 421. A plurality of hooks 417 (in FIG. 6) protruding from the rear surface of the outer cover 41 insert in the center hook insert holes 431. By inserting the plurality of hooks formed on the outer cover 41 into the center hook insert holes 431, the cabinet cover 42 and the outer cover 41 may be more tightly coupled. That is, the center hook insert hole 431 is cut and bent using lancing processing on a portion of the inner perimeter of the door mount 421. The cut and bent extending tabs are hooked on the hooks 417 of the outer cover 41.

A plurality of recesses 422 are formed a predetermined depth in the cabinet cover 42 recessed toward the rear. These recesses 422 are for mounting fastening bosses 415 (in FIG. 6) protruding a predetermined distance from the rear surface of the outer cover 41, so that the outer cover 41 and the cabinet cover 42 are prevented from being spaced apart by means of the fastening bosses 415.

At least one lower rib insert hole 430 is formed at a predetermined interval at the lower end of the front surface of the cabinet cover 42. In more detail, the lower rib insert hole 430 has a lower rib 418 (in FIG. 5) protruding at a predetermined interval from the lower rear surface of the outer cover 41 and inserted therethrough. A bolting hole 427 is formed in the lower bent surface of the cabinet cover 42, and is coupled to the lower frame 53 by a fastening member. A supporting slot 428*c* is formed at a predetermined interval along the bent surface at the bottom of the cabinet cover 42. A supporting rib 221 that protrudes toward the front of the lower panel 22 (to be described later) is inserted in the supporting slot 428*c*. The process of inserting the supporting rib 221 in the supporting slot 428*c* will be explained below with reference to the diagrams.

Figure 5:
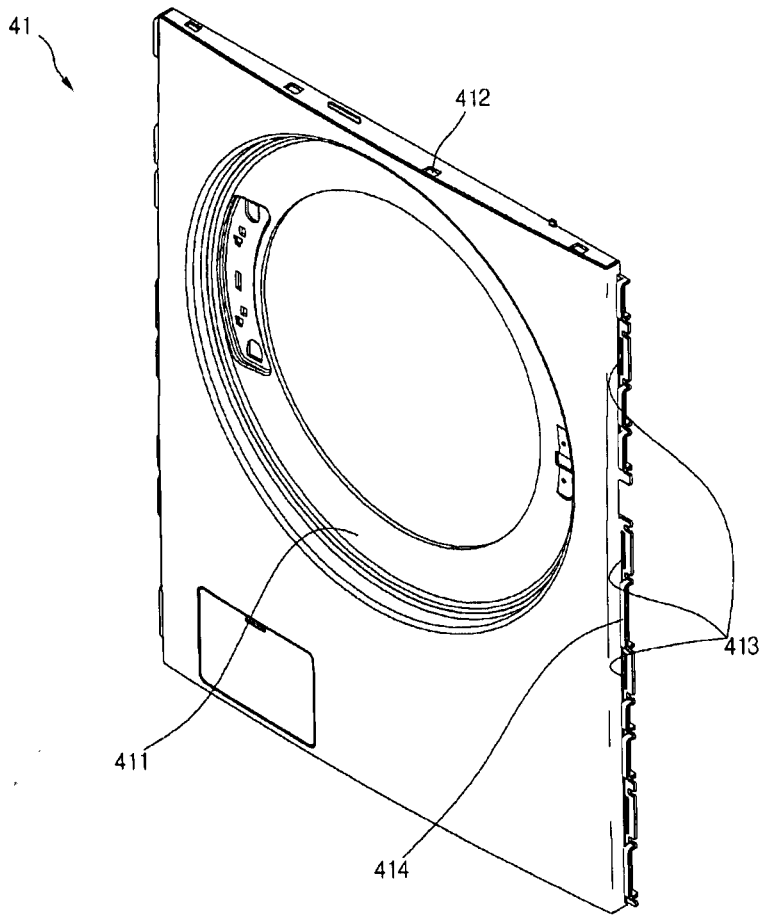
FIG. 5 is a frontal perspective view of an outer cover of a front portion of a cleaning apparatus according to the present invention.
Figure 6:
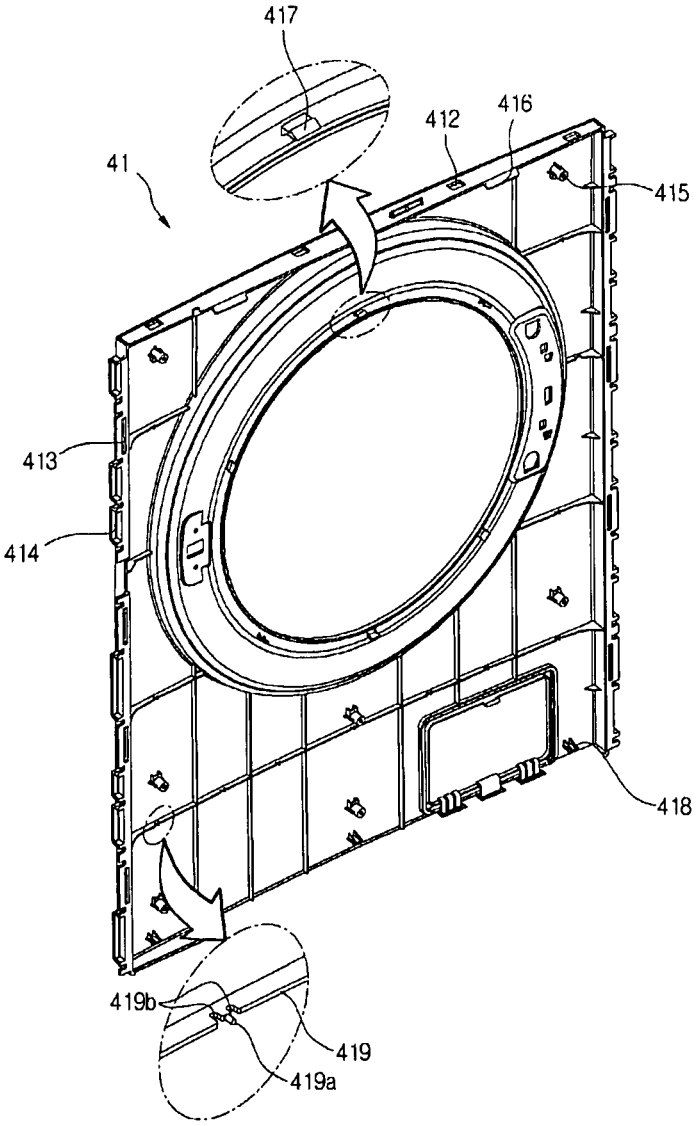
FIG. 6 is a rear perspective view of the outer cover in FIG. 5.

FIG. 5 is a frontal perspective view of an outer cover of a front portion of a cleaning apparatus according to the present invention, and FIG. 6 is a rear perspective view of the outer cover in FIG. 5.

Referring to FIGS. 5 and 6, an outer cover 4 according to the present invention is mounted to the front surface of the cabinet cover 42, and is formed of a plastic injection molded material having a predetermined color.

Specifically, the outer cover 41 is first formed through plastic injection molding, after which it is sprayed with paint on its front surface and then dried.

In further detail, erosion due to painting of the plastic material should be obviated. Moreover, because the outer cover 41 is manufactured using a relatively large mold, the plastic used to form the outer cover 41 must have favorable flow characteristics during injection molding. Should erosion result from painting, or flow during injection molding be unfavorable, the surface will not be smooth, and an even layer of paint cannot be obtained with painting. When considering such factors, ABS resin such as GP35 manufactured by BASF may be used.

Regarding the mold used for injection molding of the outer cover 41, the portion used to form the front surface of outer cover 41 may have superfinishing treatment so that the front surface of the outer cover 41 can maintain a polish and an even application of paint.

To paint the front surface of the outer cover 41 manufactured through the injection molding process, a paint with an acrylic base resin and a predetermined color is prepared. To create a luster, a metal powder may be added, such as an aluminum powder used in pigments. For mass-production, a spray-on application may be used, for which a solvent may be used in order to reduce the viscosity of the paint. A good solvent to use is isopropylene alcohol.

The outer cover 41 covered with the paint is dried over a predetermined duration at a predetermined temperature.

In further detail, the outer cover 41 may be dried at a temperature of 60°-70° C. for a 40 minute duration. If the paint is dried at a temperature below 60° C., it will not adhere well to the surface and is prone to peeling off when rubbed against other objects. Conversely, if a drying temperature above 70° C. is used, the outer cover 41 will be prone to deformation. Therefore, a material having a heat resistance that prevents deformation thereof at temperatures over 60° C. may be used.

In still further detail, in order to mount the door 6 on the front of the outer cover 41, a door mount 411 is recessed a predetermined depth therein. An open hole is formed within the door mount 411 for inserting and extracting laundry. Around the rear of the perimeter of the open hole, a plurality of center hooks 417 are protrusively formed to insert into center hook insert holes 431 formed on the cabinet cover 42. Side frame fastening tabs 414 for coupling with the side frame 52 are formed to protrude from the side of the outer cover 41. At least one frame rib insert hole 413 is formed between the side frame fastening tabs 414, for inserting a frame rib 526 (in FIG. 9) protruding from the inner surface of the side frame 52. A rib insert hole 412 is formed at a predetermined interval on the upper surface of the outer cover 41, to insert an outer cover fastening rib 75 (in FIG. 15) protruding from the bottom surface of the control panel 7.

At least one upper rib 416 is formed at the rear of the upper portion of the outer cover 41. In detail, the upper rib 416 is inserted into the upper rib insert hole 426 formed on the upper surface of the cabinet cover 42. The process of inserting the upper rib 416 in the upper rib insert hole 426 can be seen in detail in FIG. 18.

A plurality of fastening bosses 415 with a predetermined length are formed at predetermined locations on the rear surface of the outer cover 41. Specifically, the fastening bosses 415 contact the recesses 422 recessed a predetermined depth in the front surface of the cabinet cover 42. A fastening member passes through from the rear surface of the cabinet cover 42 and inserts in a hole formed in the center of the recess 422. Here, the recess 422 is recessed by almost the same distance as the length of the fastening boss 415, so that the outer cover 41 can couple firmly with the front surface of the cabinet cover 42. The fastening member inserts within the fastening boss 415, to firmly couple the cabinet cover 42 and the outer cover 41. As described above, a plurality of lower ribs 418 protrude at the lower end of the outer cover 41 and insert into the lower rib insert holes 430 formed at the bottom of the cabinet cover 42.

Also, ribs 419 formed on the rear surface of the outer cover 41 are latticed.

In detail, to prevent vibration and noise when the outer cover 41 contacts the cabinet cover 42, the contacting surface between the outer cover 41 and the cabinet cover 42 should be minimal, so that a contacting protrusion 419*a* is formed to protrude from the rib 419 to contact the front surface of the cabinet cover 42. To prevent water from accumulating between the front of the cabinet cover 42 and the rib 419 and resulting corrosion of the cabinet cover 42, the rib 419 has drain grooves 419*b* formed therein.

Figure 7:
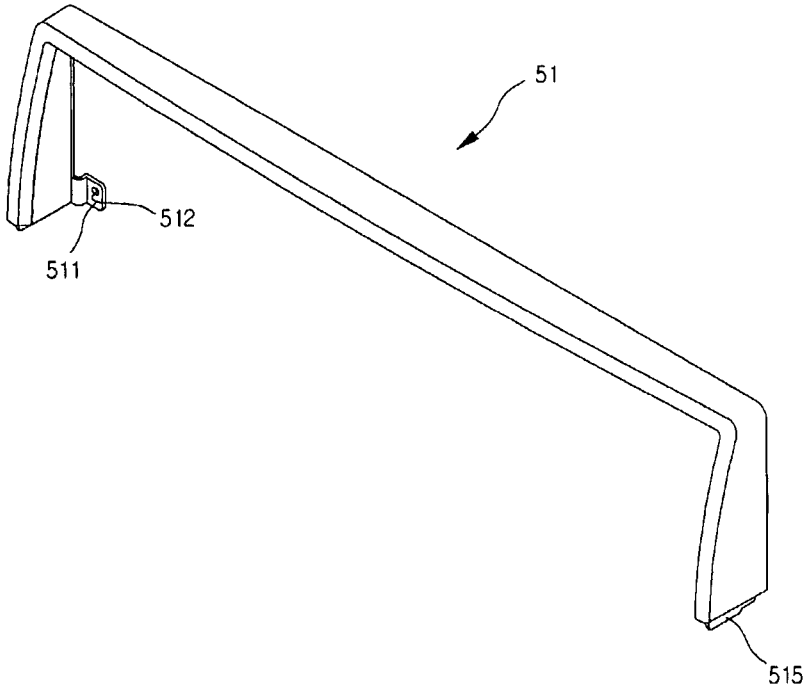
FIG. 7 is a frontal perspective view of an upper frame of a fringe frame of a front portion of a cleaning apparatus according to the present invention.
Figure 8:
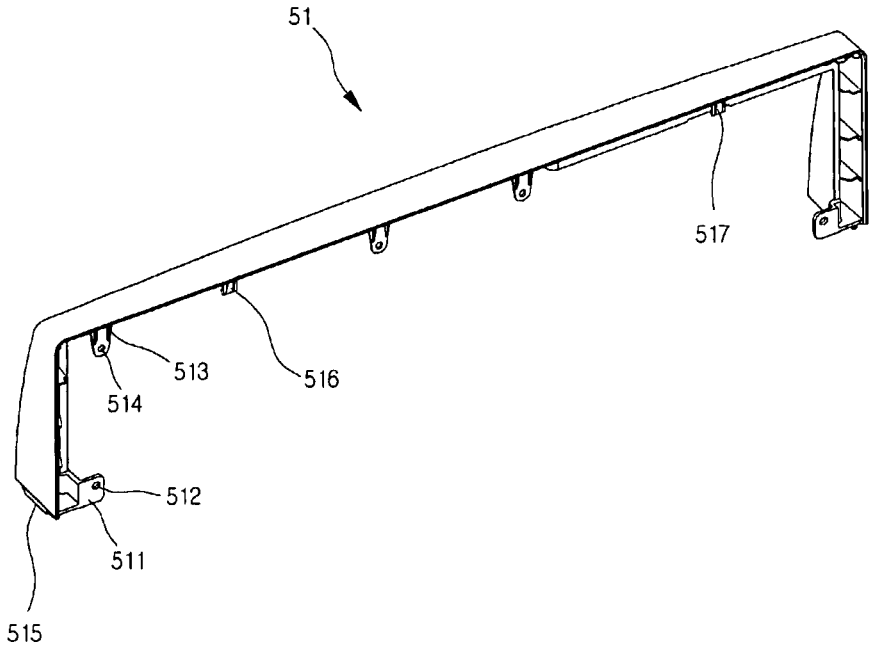
FIG. 8 is a rear perspective view of the upper frame in FIG. 7.

FIG. 7 is a frontal perspective view of an upper frame of a fringe frame of a front portion of a cleaning apparatus according to the present invention, and FIG. 8 is a rear perspective view of the upper frame in FIG. 7.

Referring to FIGS. 7 and 8, an upper frame 51 that is a component of the fringe frame 5 according to the present invention is formed in an inverted 'u' shape in order to cover the upper and side edges of the control panel 7.

Specifically, the upper frame 51 includes a cabinet cover fastening tab 511 extending a predetermined distance from the rear surface on either side thereof, a control panel fastening tab 513 extending a predetermined distance downward from the upper rear portion thereof, and a fixing rib 515 having a predetermined length and width extending from the bottom on either side thereof. Also, a first rib 516 is formed to protrude downward a predetermined distance from the rear upper portion of the upper frame 51, and a second rib 517 is formed at a predetermined distance from the first rib 516 to protrude downward a predetermined distance from the rear upper portion of the upper frame 51. The first and second ribs 516 and 517 insert into insert holes formed in the upper surface of the upper panel (which will be described later), so that the upper frame 51 is fixedly mounted to the upper panel.

In further detail, the cabinet cover fastening tab 511 couples to the upper guide rib 424 that is bent on the upper portion of the cabinet cover 42. In other words, the upper frame fastening hole 424*b* formed in either side ends of the upper guide rib 424 and the fastening hole 512 formed in the cabinet cover fastening tab 511 are fastened together by means of an inserted screw or other fastening member.

Additionally, the control panel fastening tab 513 is coupled to a fastening boss 73 (in FIG. 14) protruding from the rear surface of the control panel 7. The fixing rib 515 extending from the lower portion on either side of the upper frame 51 inserts in a fixing rib insert hole 524 (in FIG. 9) formed in an upper surface of the side frame 52. That is, in the above assembly process, the upper frame 51 is coupled with the side frame 52 and control panel 7 as well as the cabinet cover 42.

In further detail, the side of the upper frame 51 has side surfaces with a predetermined thickness extending from front to back at the location where the detergent box 8 is installed, in order to guide the movement of the detergent box 8 when it is inserted or pulled out.

By installing the upper frame 51, the front edge portion of the top cover 3 covering the upper portion of the cabinet 2 is coupled firmly against the rear surface at the top of the upper frame 51.

Figure 9:
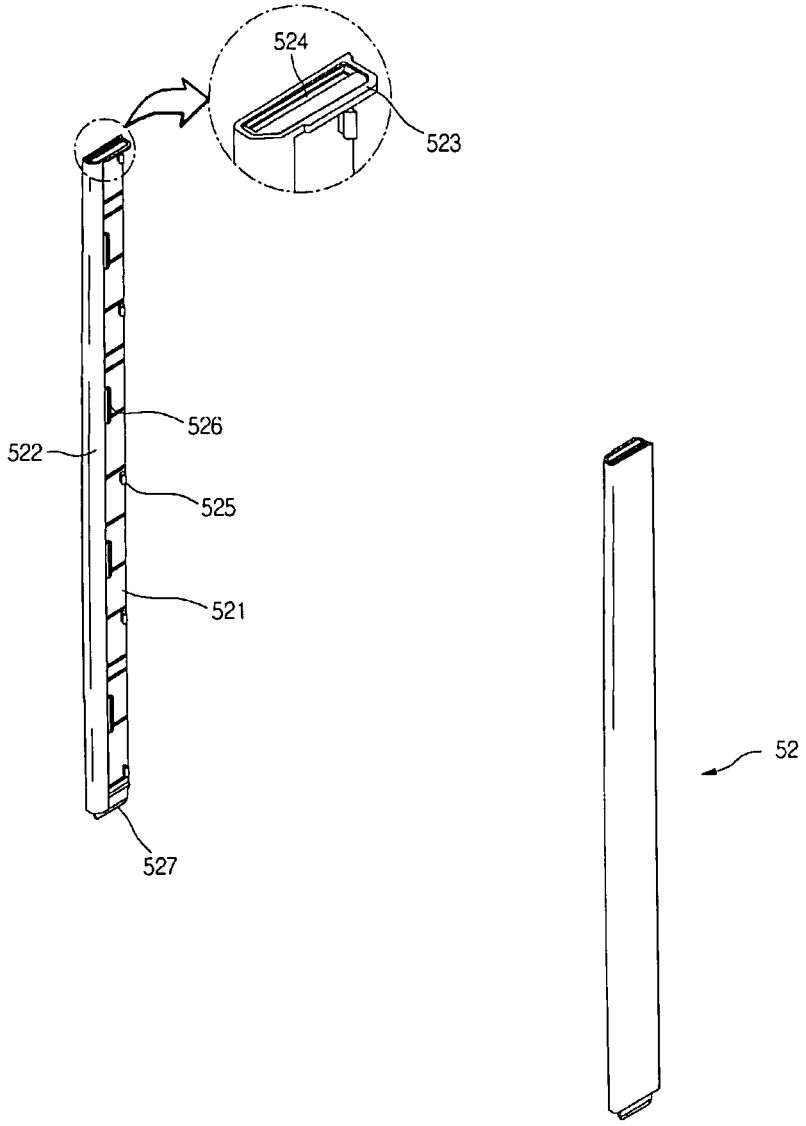
FIG. 9 is a frontal perspective view of a side frame of a fringe frame of a front portion of a cleaning apparatus according to the present invention.
Figure 10:
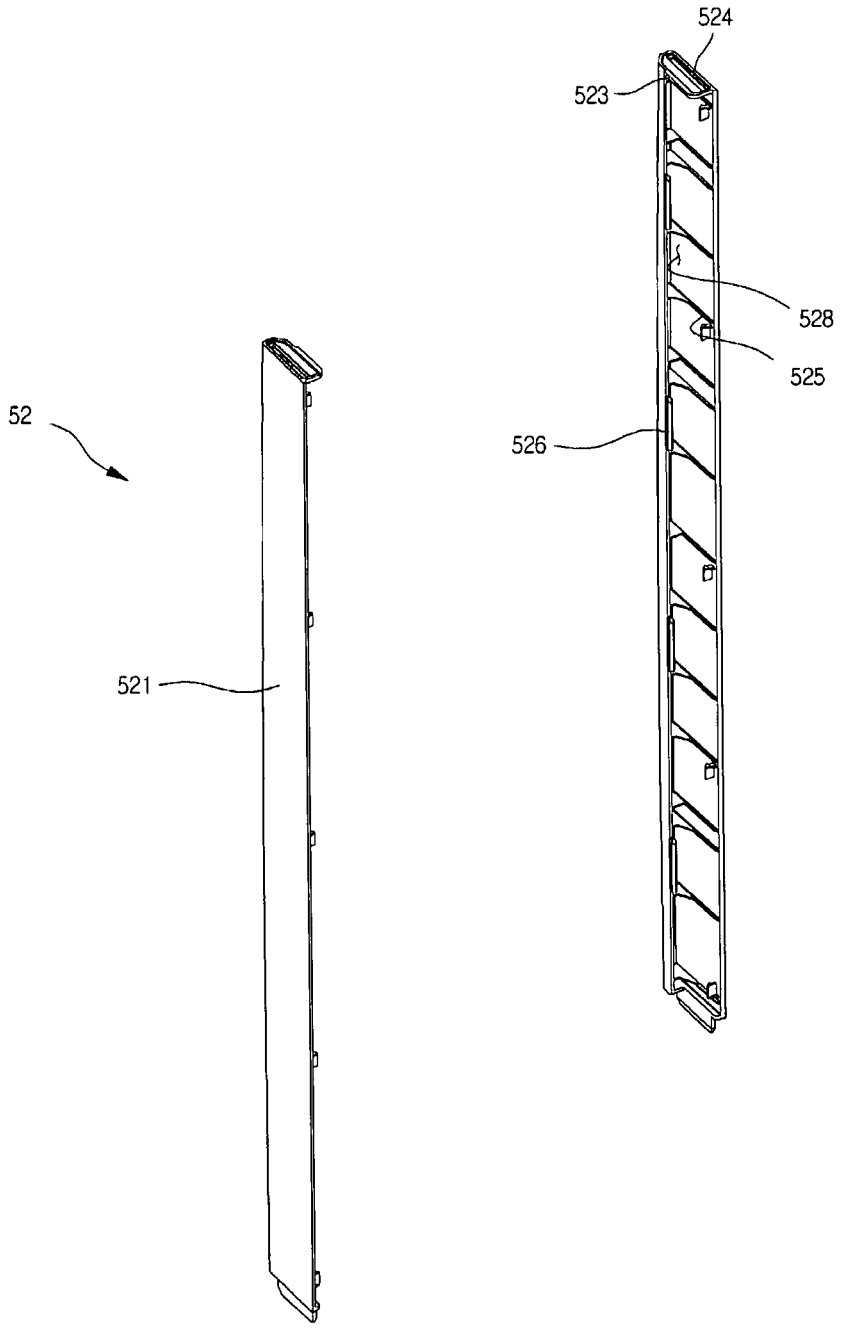
FIG. 10 is a rear perspective view of the side frame in FIG. 9.

FIG. 9 is a frontal perspective view of a side frame of a fringe frame of a front portion of a cleaning apparatus according to the present invention, and FIG. 10 is a rear perspective view of the side frame in FIG. 9.

Referring to FIGS. 9 and 10, the side frame 52 according to the present invention is formed in a predetermined width and length to cover the side edges of the cabinet cover 42 and the outer cover 41. By covering the joining portion of the cabinet cover 42 and the outer cover 41, a clean outer appearance is achieved.

In detail, the side frame 52 includes a frame body 521 that is rectangular in shape, a frame front 522 bent at a predetermined curvature from the front end of the frame body 521, an upper frame mounting tab 523 bent horizontally from the upper end of the side frame 52, and a standing rib 527 extending a predetermined length from the lower end of the side frame 52.

In further detail, a fixing rib insert hole 524 is formed on the upper frame mounting tab 523 to insert the fixing rib 515 formed at the bottom end of the upper frame 51. Also, a plurality of frame ribs 526 having a predetermined width and length are spaced a predetermined distance apart on the end of the frame front 522. Here, the frame rib 526 is inserted in the frame rib insert hole 413 formed in the side surface of the outer cover 41.

At least one frame hook 525 protrudes at a predetermined interval from the rear inner side of the frame body 521. That is, the frame hook 525 inserts in the frame hook insert hole 423 formed in the side of the cabinet cover 42.

An insert recess 528 is formed in the inner surface of the frame front 522 in order to insert the side frame fastening tab 414 formed on the side surface of the outer cover 41.

In the above structure, the upper end of the side frame 52 is coupled with the upper frame 51, its lower end is coupled with the lower frame 453, and its inner surface is coupled with the outer cover 41 and the cabinet cover 42. Also, the side frame 52 is coupled to the components without the use of screws or other fastening members.

Figure 11:
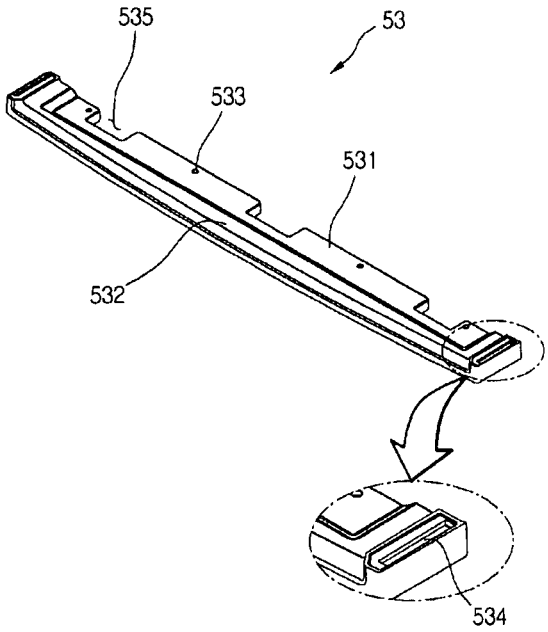
FIG. 11 is a frontal perspective view of a lower frame of a fringe frame of a front portion of a cleaning apparatus according to the present invention.
Figure 12:
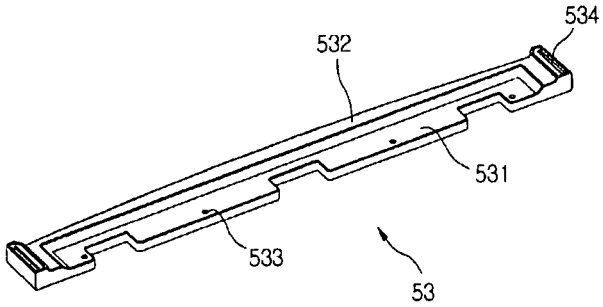
FIG. 12 is a rear perspective view of the lower frame in FIG. 11.

FIG. 11 is a frontal perspective view of a lower frame of a fringe frame of a front portion of a cleaning apparatus according to the present invention, and FIG. 12 is a rear perspective view of the lower frame in FIG. 11.

Referring to FIGS. 11 and 12, a lower frame 53 of the fringe frame 5 according to the present invention includes an outer cover mount 532 on its upper surface for mounting the outer cover 41 on, a cabinet cover mount 531 extending a predetermined distance rearward from the outer cover mount 532, and a standing rib insert slot 534 formed in the upper surface on either end, for inserting the standing rib 527 of the side frame 52. A plurality of supporting rib receiving notches 535 are recessed a predetermined depth forward at the rear end of the lower frame 53. Here, the supporting rib receiving notches 535 are formed to prevent a supporting rib 221 (in FIG. 16, to be later described) from interfering with the lower frame 53.

Specifically, at least one bolting hole 533 is formed on the cabinet cover mount 531, so that the lower frame 53 and the cabinet cover 42 can be coupled with a fastening member. In more detail, a screw or other fastening member inserts through the bolting hole 533 and the bolting hole 427 formed in the lower end of the cabinet cover 42. Thus, the lower frame 53 is coupled to the cabinet cover 42 by means of the screw or other fastening member, and both its end portions are assembled with the side frame 52.

The fringe frame 5 that covers the edges of the front panel 4 and the control panel 7 prevents the front panel 4 and the control panel 7 from being damaged due to external forces. Supposing that a shock is applied from the outside, only a portion of the fringe frame 5 is damaged, protecting the front panel 4. Also, only the damaged portion of the fringe frame 5 needs to be replaced, not only facilitating repair, but also reducing repair costs.

Figure 13:
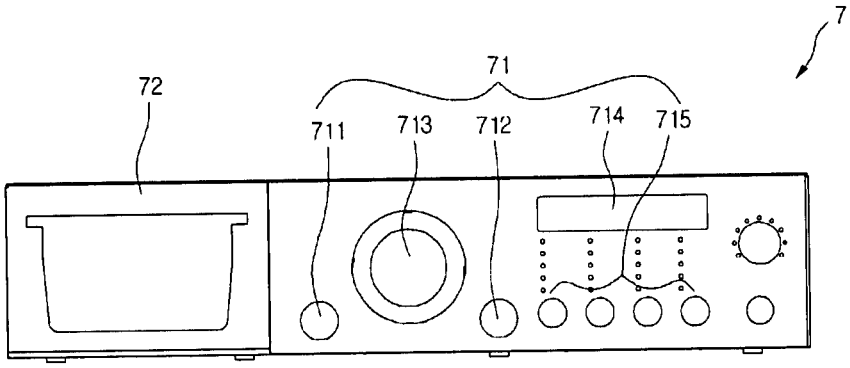
FIG. 13 is a frontal view of a control panel according to the present invention.
Figure 14:
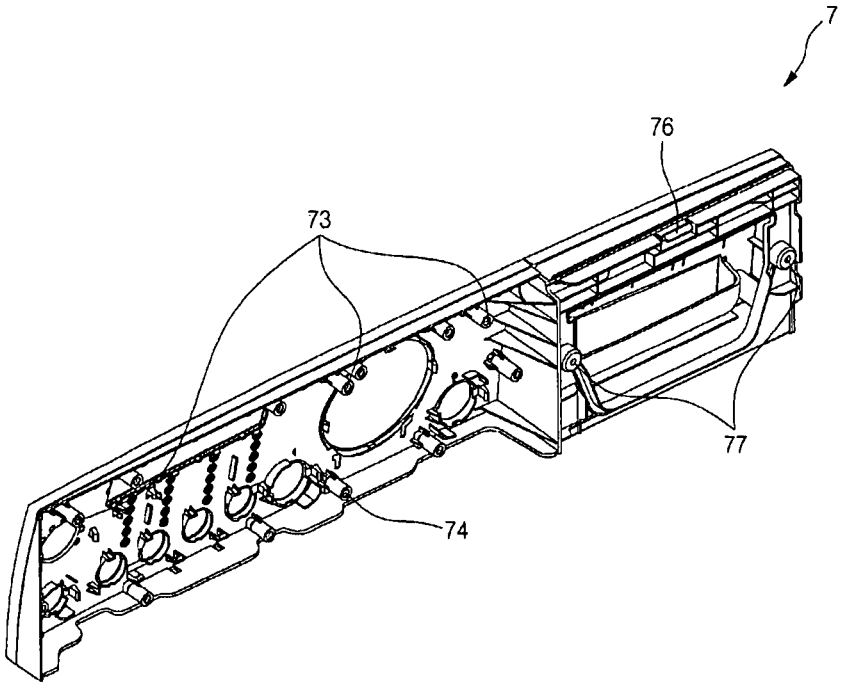
FIG. 14 is a rear perspective view of the control panel in FIG. 13.
Figure 15:
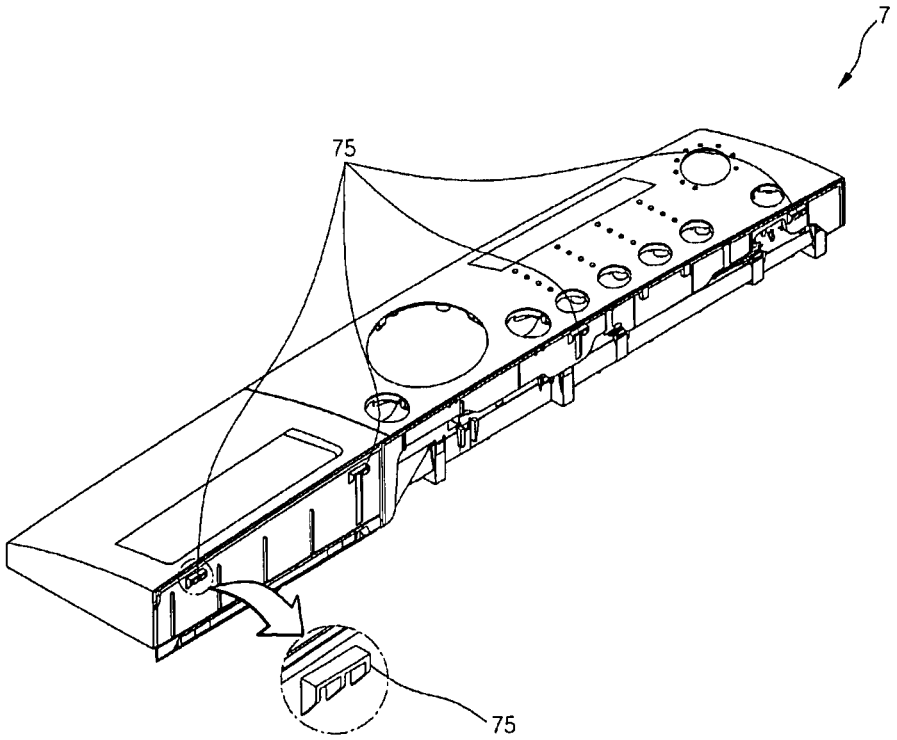
FIG. 15 is a bottom perspective view of the control panel in FIG. 13.

FIG. 13 is a frontal view of a control panel according to the present invention, FIG. 14 is a rear perspective view of the control panel in FIG. 13, and FIG. 15 is a bottom perspective view of the control panel in FIG. 13.

Referring to FIGS. 13 through 15, a control panel 7 according to the present invention is enclosed on its upper and side surfaces by the upper frame 51, and its lower portion is coupled to the upper surface of the front panel 4.

Specifically, the control panel 7 includes an input section 71 on one side of a front thereof with various controls, and a detergent box section 72 on the other end of the front section for inserting the detergent box into.

In further detail, the input section 71 includes a power button 711, a dial knob insert hole 713 for inserting a dial knob that inputs wash commands, a start button 712, a display 714, and setting buttons 715 for inputting wash settings.

Installed at the back of the control panel 7 is a PCB (printed circuit board) for storing and implementing the commands inputted through the input section 71.

Figure 23:
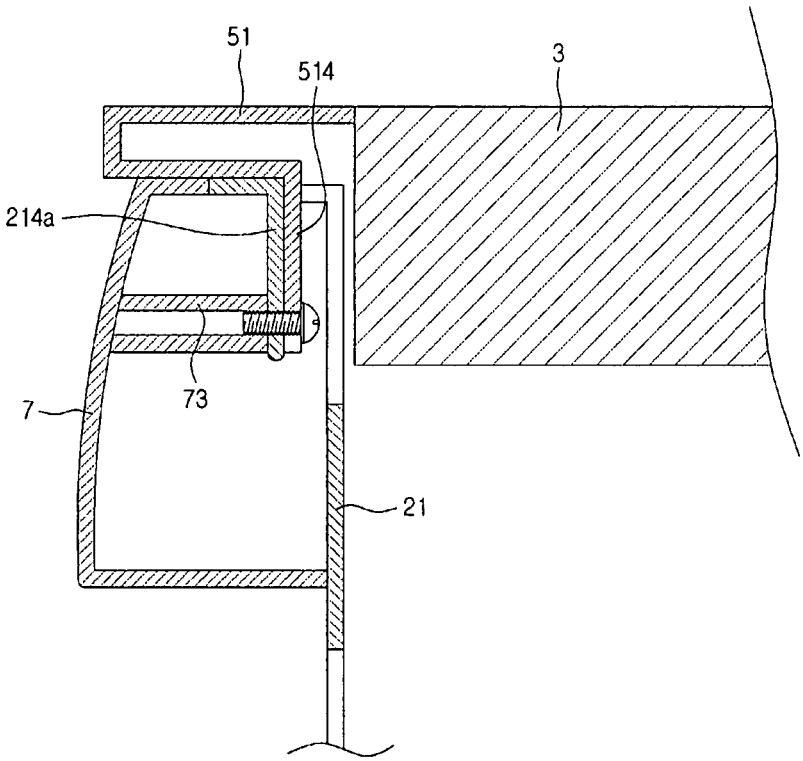
FIG. 23 is a side sectional view showing an upper frame and control panel coupled to an upper panel according to the present invention.

In more detail, a PCB fastening boss protrudes a predetermined length from the rear surface of the control panel 7, in order to mount the PCB thereon. An upper frame fastening boss 73 is formed to protrude from the rear upper end of the control panel 7, so that the upper frame fastening boss 73 is pressed against the front surface of an upper frame fastening tab 214*a* (in FIG. 16) formed on the upper panel 21. Here, the control frame fastening tab 513 formed on the upper frame 51 is pressed against the rear surface of the upper frame fastening tab 214*a*. Accordingly, after a screw or other fastening member inserts from the rear to the front of the fastening hole 514 formed on the control panel fastening tab 513, it is inserted into the upper frame fastening boss 73, so that the control panel 7 and the upper frame 51 are assembled integrally with the upper panel 21. FIG. 23 shows the above assembly structure in more detail.

An outer cover fixing rib 75 is formed at a predetermined interval on the front surface of the control panel 7. The outer cover fixing rib 75 inserts into the rib insert hole 412 formed in the upper surface of the outer cover 41. Thus, when the control panel 7 is mounted on the outer cover 41, there is no oscillating thereof due to external forces.

Also, a panel hook 76 is formed on the rear surface at the top of the control panel 7 and is inserted into a hole 213*a* (in FIG. 16) to be described later, so that the control panel 7 does not move with respect to the upper panel. A dispenser fastening boss 77 is formed to protrude from the rear surface of the control panel 7. A fastening member is inserted from the front of the control panel 7 into the dispenser fastening boss 77. The fastening member passing through the dispenser fastening boss 77 is inserted into a fastening hole (not shown) formed at the front surface of the dispenser installed inside the cabinet 2 for holding the detergent box. That is, the control panel 7 is coupled to the dispenser to prevent movement thereof.

Figure 16:
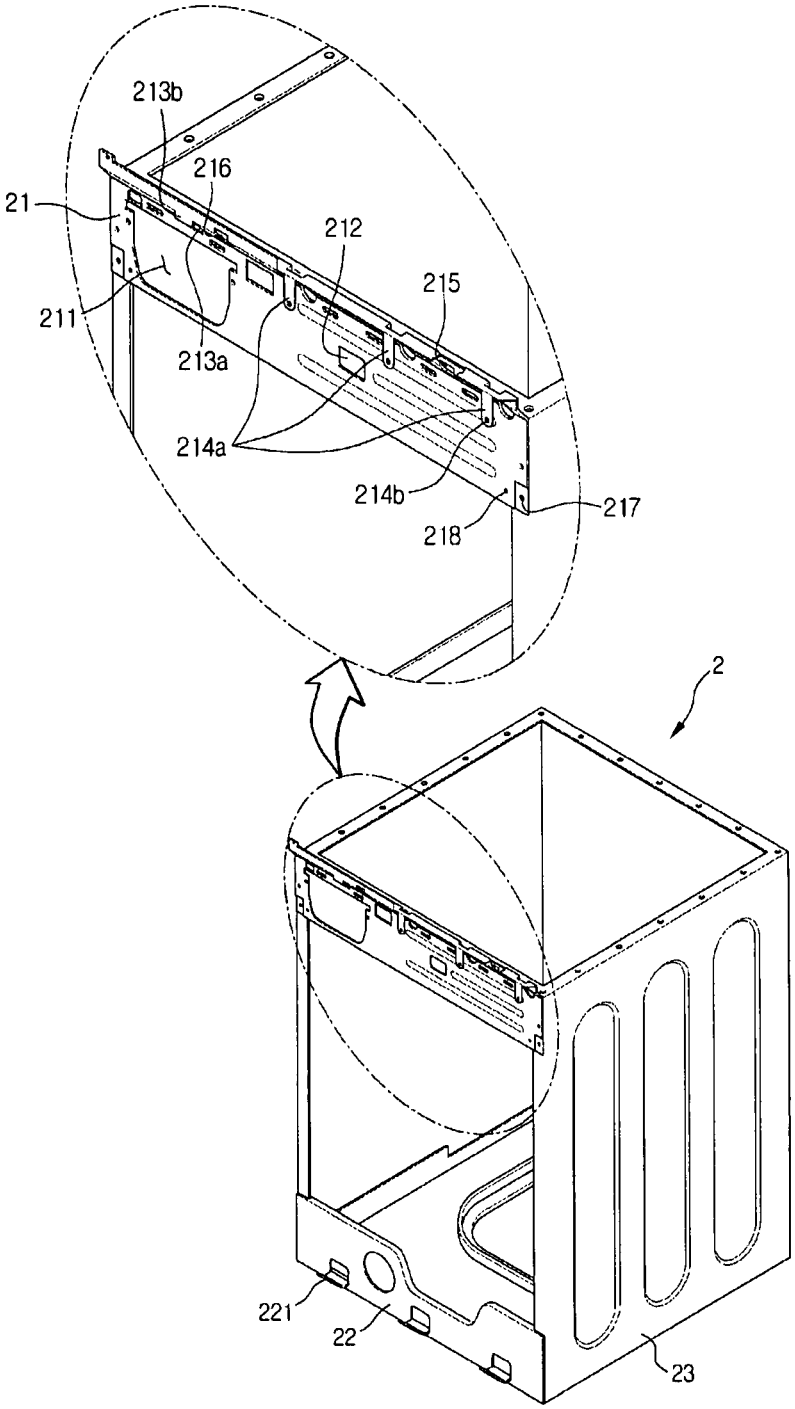
FIG. 16 is a perspective view of a cabinet on which a front panel is installed according to the present invention.

FIG. 16 is a perspective view of a cabinet on which a front panel is installed according to the present invention.

Referring to FIG. 16, the cabinet 2 according to the present invention includes a main body 23 recessed in a rough 'n' shape when viewed in a horizontal section, an upper panel connecting both ends of the main body 23, and a lower panel 22.

In detail, the cabinet 2 has either an open front where the front panel 4 is installed and has its side and rear surfaces integrally formed, or has its side surfaces integrally formed with the front panel 4 with the rear opened.

The cabinet 2 may have separate components assembled to compose its four surfaces, an opening formed in one of the surfaces for inputting laundry, and the front panel 4 installed on the surface in which the opening is formed.

Also, built-in type cleaning apparatuses may not include the side or rear cabinets.

Here, the shape of the cabinet 2 is not limited to those described in the above embodiments, but may adopt a variety of shapes and still fall within the scope of the present invention.

The upper panel 21 installed on the front surface at the top of the main body 23 includes a detergent box insert hole 211 formed at one side thereof for inserting the detergent box therein, an electric wire insert hole 212 cut a predetermined size in the approximate center of the upper panel 21 for inserting wires connected to the control panel 7 through, a hook insert hole 213*a* formed in the upper edge of the upper panel 21 for inserting the panel hook 76 formed on the control panel 7, and a hook latch tab 213*b* for latching the hook 76 and preventing it from detaching.

The upper panel 21 also includes at least one upper frame fastening tab 214*a* extending a predetermined distance downward from the upper edge of the upper panel, and a first and a second rib insert hole 215 and 216 formed on the upper edge of the upper panel. Here, the first and second ribs 516 and 517 formed on the rear surface of the upper frame 51 are inserted into the first and second rib insert holes 215 and 216.

In detail, the fastening hole 214*b* is formed on the end of the upper frame fastening tab 214*a*, for inserting a fastening member through. The control panel fastening tab 513 of the upper frame 51 is disposed at the rear surface of the upper frame fastening tab 214*a*. The upper frame fastening boss 73 protruding from the rear surface of the control panel 7 is disposed on the front surface of the upper frame fastening tab 214*a*. A fastening member passes through the control panel fastening tab 513 and the upper frame fastening tab 214*a* and inserts in the upper frame fastening boss 73.

The upper panel 21 also includes a cabinet cover fastening hole 217 on the bottom at either end thereof for fastening to the cabinet cover 42, and an upper frame fastening hole 218 for fastening with the upper frame 51. Here, an upper frame fastening hole 424*b* formed on the cabinet cover 42 is disposed at the front surface of the upper frame fastening hole 218. The cabinet cover fastening tab 511 formed on the upper frame 51 is disposed at the front surface of the upper frame fastening hole 424*b*. In other words, the fastening hole 512 formed in the cabinet cover fastening tab 511 is disposed in front of the upper frame fastening hole 424*b*. Accordingly, the upper frame 51, cabinet cover 42, and upper panel 21 are integrally coupled by means of a fastening member.

The panel hook 76 formed on the rear surface of the control panel 7 inserts in the hook insert hole 213*a* formed in the upper portion of the upper panel 21, and the upper surface of the panel hook 76 hooks onto the hook latch tab 213*b*. Thus, the control panel 7 couples at one end to the upper panel 21, where the panel hook 76 does not detach easily. Also, the first and second ribs 516 and 517 protruding from the upper rear surface of the upper frame 51 insert respectively into the first and second rib insert holes 215 and 216 formed on the upper edge surface of the upper panel 21, so that the upper frame 51 is coupled to the upper panel 21 and does not move.

The lower panel 22 coupled at the bottom of the main body 23 has at least one supporting rib 221 formed at a predetermined interval at the bottom thereof.

In detail, the supporting rib 221 is cut in a predetermined size from a portion of the lower panel 22, and the cut portion is then bent forward at a predetermined angle through lancing processing, as shown in the FIG. 16. The supporting rib 221 is inserted into the supporting slot 428*c* formed in the bent surface of the lower portion of the cabinet cover 42, as described above.

Figure 17:
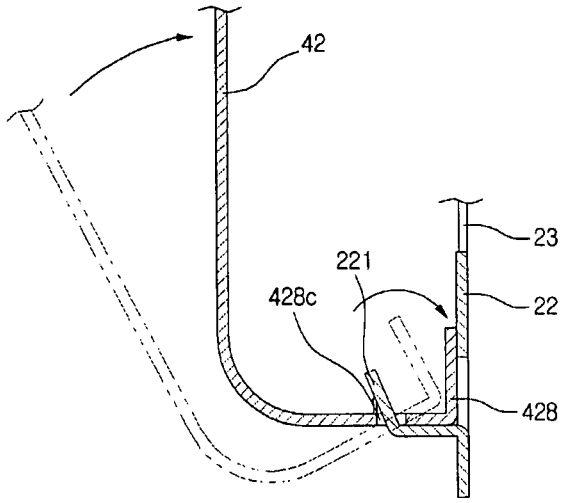
FIG. 17 is a sectional view showing the assembly of a lower portion of a cabinet cover with a lower panel according to the present invention.

FIG. 17 is a sectional view showing the assembly of a lower portion of a cabinet cover with a lower panel according to the present invention.

Referring to FIG. 17, a lower portion of the cabinet cover 42 according to the present invention is fastened by means of the supporting rib 221 of the lower panel 22.

In detail, the supporting rib 21 is bent in a forward and upward shape, where the upwardly bent portion is bent slightly to incline forward. Thus, in order to insert the supporting rib 21 in the supporting slot 428*c*, the upper portion of the cabinet cover 42 is first inclined forward at a predetermined angle. In this state, the end of the supporting rib 221 is inserted into the supporting slot 428*c*, and then the upper portion of the cabinet cover 42 is pushed and rotated to press against the upper panel 21 of the cabinet 2. Thus, the lower surface of the cabinet cover 42 mounts to the upper surface of the supporting rib 221, and the lower guide rib 428 of the cabinet cover 42 presses against the front surface of the lower panel 22.

Figure 18:
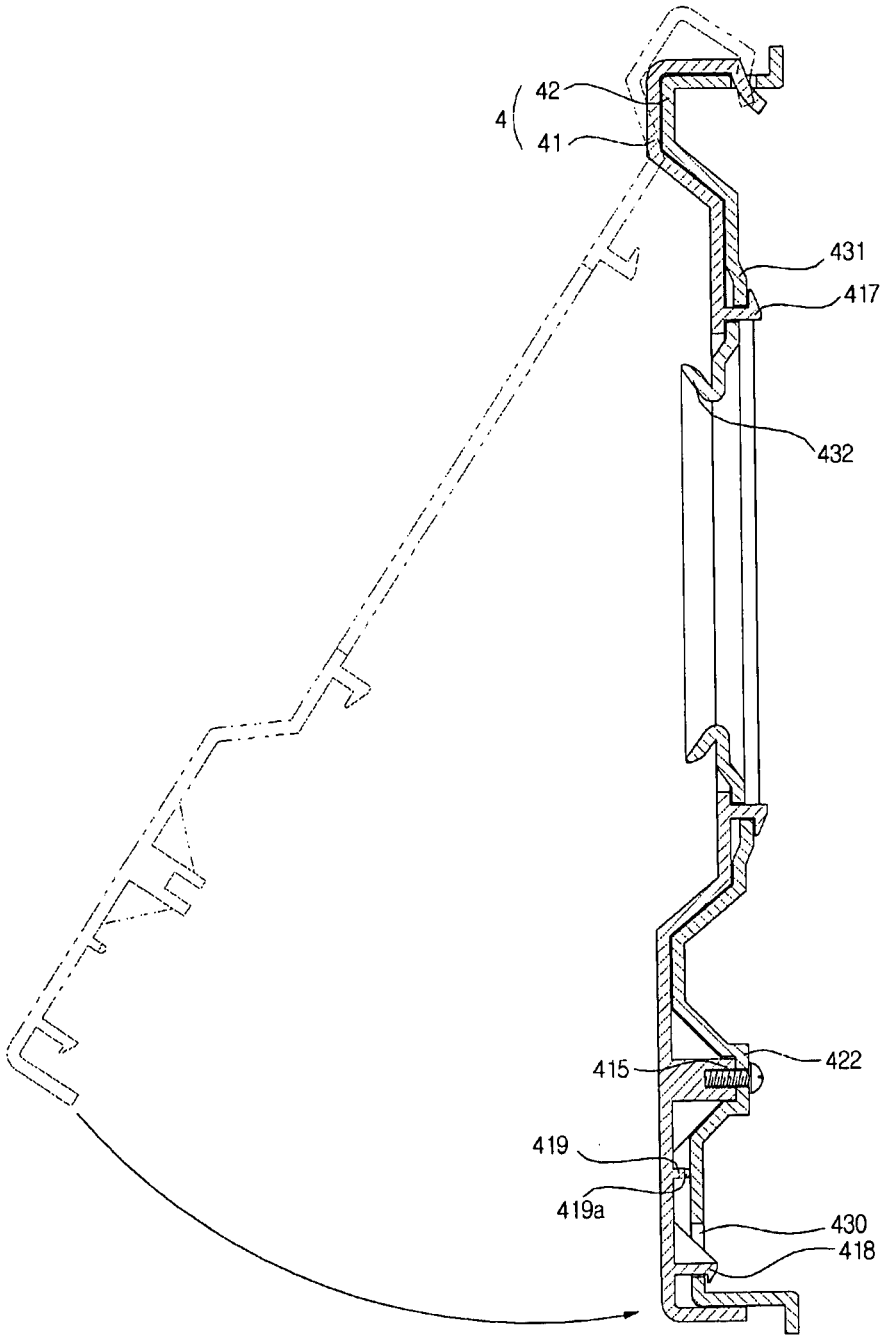
FIG. 18 is a sectional view showing the assembly of an outer cover to a cabinet cover according to the present invention.

FIG. 18 is a sectional view showing the assembly of an outer cover to a cabinet cover according to the present invention.

Referring to FIG. 18, an outer cover 41 according to the present invention is first coupled at its upper surface to the upper surface of the cabinet cover 42, after which other portions are coupled.

In detail, a plurality of upper ribs 416, spaced a predetermined distance apart from each other, are formed on the upper edge surface of the outer cover 41 to extend downward. The upper ribs 416 extend vertically and then curve gently or bend abruptly rearward. Thus, in order to fasten the outer cover 41 to the cabinet cover 42, the lower end of the outer cover 41 is lifted slightly. Then, the curved portion of the upper rib 416 is inserted into the upper rib insert hole 426. Next, the outer cover 41 is rotated and pressed against the front of the cabinet cover 42. In this way, the upper rib 416 is completely inserted into the upper rib insert hole 426.

Figure 19:
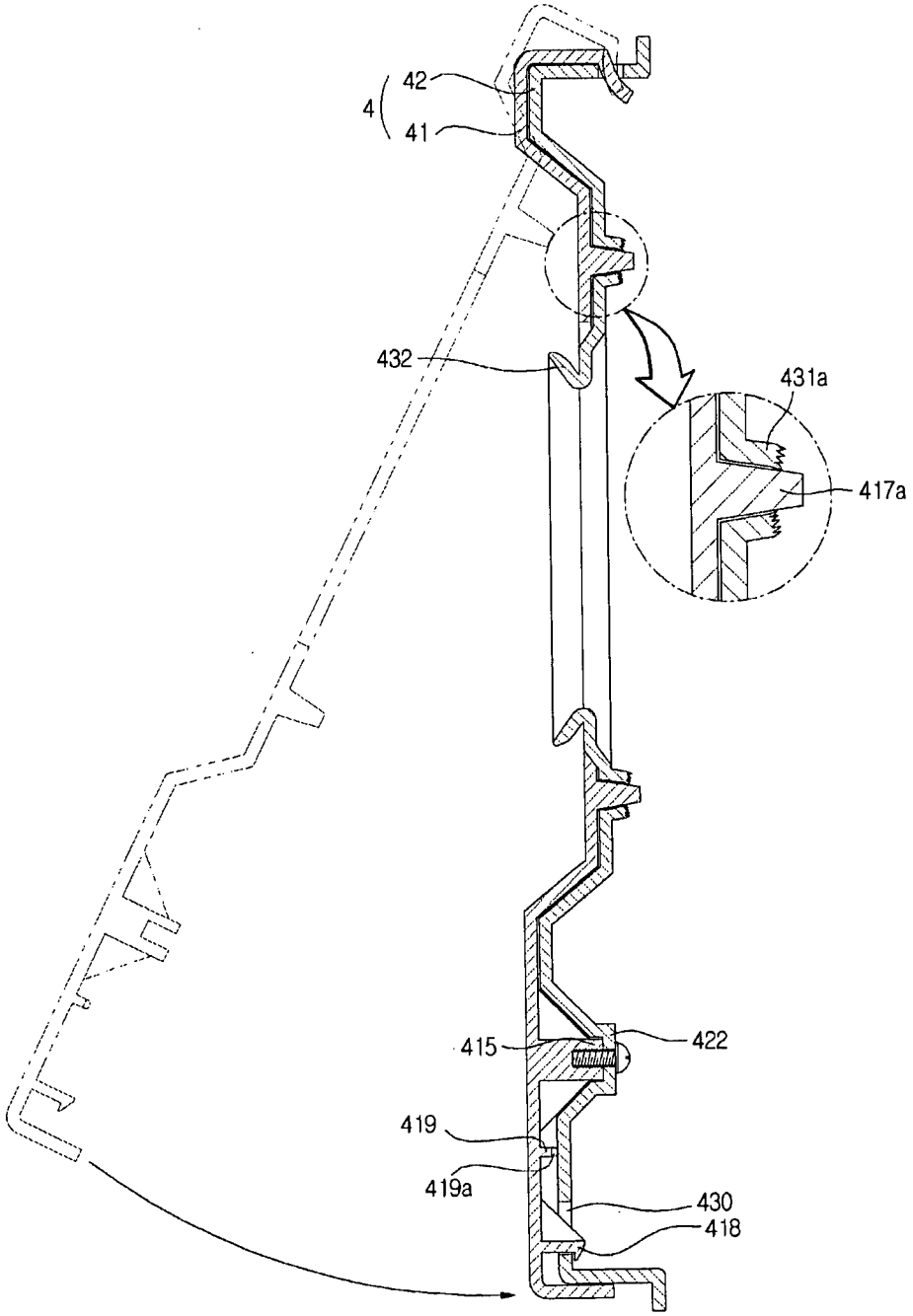
FIG. 19 is a sectional view showing another assembling of an outer cover to the front of a cabinet cover according to another embodiment of the present invention.

FIG. 19 is a sectional view showing another assembling of an outer cover to the front of a cabinet cover according to another embodiment of the present invention.

Referring to FIG. 19, a boss-shaped protrusion 417*a* is formed instead of the center hook 417 protruding from the rear surface of the outer cover 41, and a burring hole 431*a* is formed in the cabinet cover 42, for inserting the protrusion 417*a* into.

In detail, the diameter of the protrusion 417*a* may narrow toward the end, and the burring hole 431*a*, like the shape of the protrusion 417*a*, may narrow in diameter toward the rear. As a result, not only can the protrusion 417*a* be easily inserted into the burring hole 431*a*, but it does not easily disengage from the burring hole 431*a* after assembly. One method of increasing the strength of assembly of the two parts is to form the burring hole 431*a* to be the same or slightly smaller in diameter than the protrusion 417*a* to enable press fitting.

Figure 20:
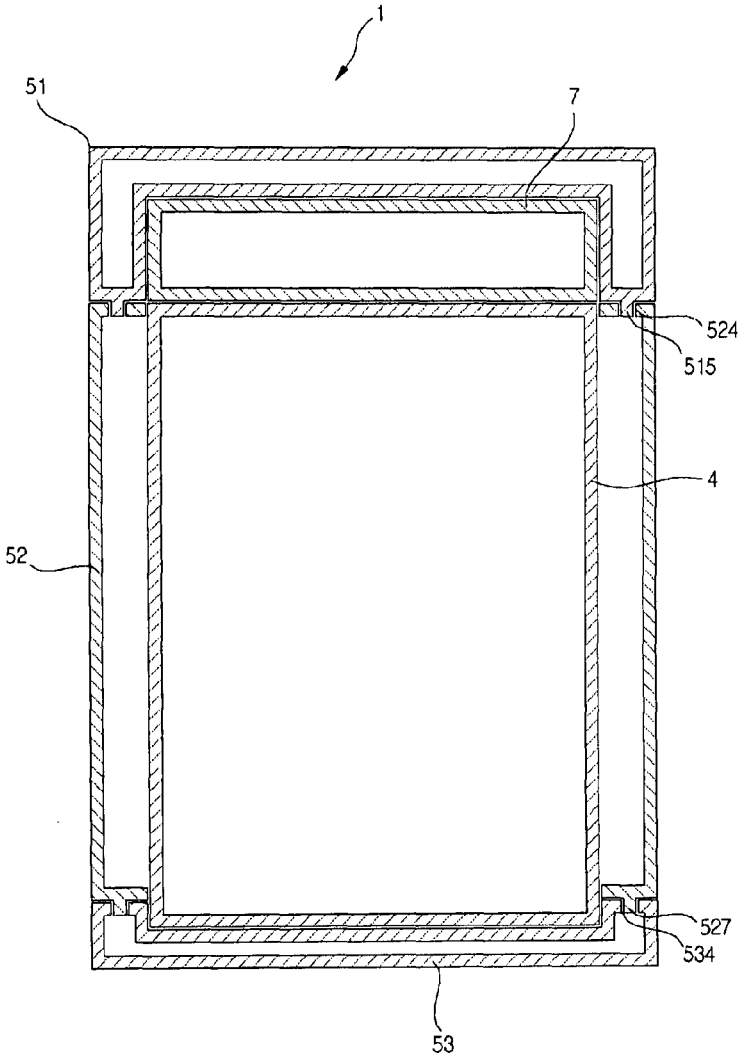
FIG. 20 is a schematic sectional view showing an assembled structure of the front portion of a cleaning apparatus according to the present invention.

FIG. 20 is a schematic sectional view showing an assembled structure of the front portion of a cleaning apparatus according to the present invention.

Referring to FIG. 20, the fringe frame 5 surrounds the edges of the front panel 4 and the control panel 7, and the different components of the fringe frame 5 are tightly coupled together.

In detail, the fringe frame 5 protects the sides with the side frames 52 that enclose both sides of the front panel 4. Coupled above the side frame 52 is the upper frame 51, and coupled therebelow is the lower frame 53. The fixing rib 515 protruding from the bottom of the upper frame 51 inserts into the upper surface of the side frame 52, so that the pieces do not move. The standing rib 527 protruding from the bottom of the side frame 52 inserts into the upper surface of the lower frame 53, so that the pieces do not move.

Figure 21:
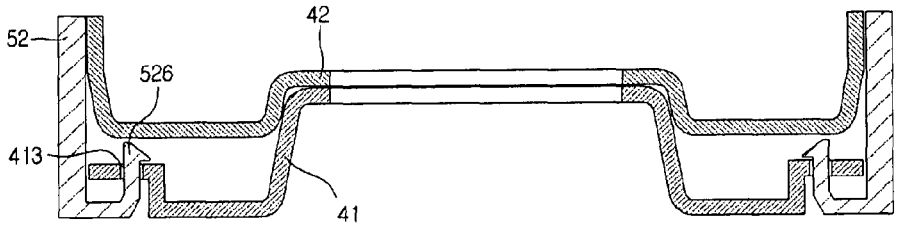
FIG. 21 is a sectional view of the cleaning apparatus in FIG. 1 taken along line I-I'.

FIG. 21 is a sectional view of the cleaning apparatus in FIG. 1 taken along line I-I'.

Referring to FIG. 21, the side frame 52 according to the present invention is integrally coupled with the outer cover 41 and the cabinet cover 42, so that the sides of the outer cover 41 and the cabinet cover 42 are concealed.

In further detail, the frame rib 526 of the side frame 52 inserts into the frame rib insert hole 413 formed on the side surface of the outer cover 41, so that the side frame 52 is fixed to the outer cover 41. The cabinet cover 42 is firmly coupled to the rear of the outer cover 41.

Figure 22:
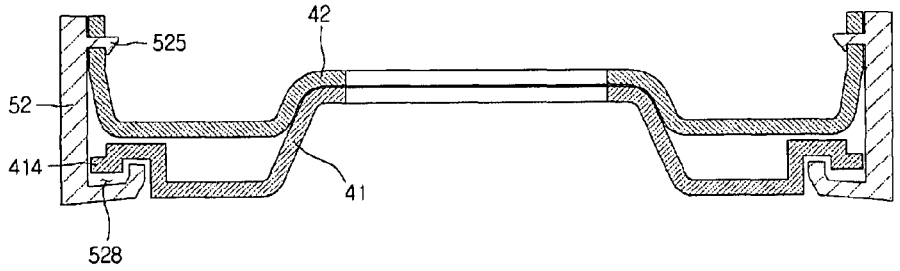
FIG. 22 is a sectional view of the cleaning apparatus in FIG. 1 taken along line II-II'.

FIG. 22 is a sectional view of the cleaning apparatus in FIG. 1 taken along line II-II'.

Referring to FIG. 22, the side frame fastening tab 414 formed on the side surface of the outer cover 41 inserts into the insert hole 528 formed at the front of the side frame 52. The frame hook 525 protruding from the inner rear surface of the side frame 52 inserts in the frame hook insert hole 423 formed on the side surface of the cabinet cover 42.

In the above assembly configuration, the cabinet cover 42 and the outer cover 41 couple integrally to the side cover 52.

FIG. 23 is a side sectional view showing an upper frame and control panel coupled to an upper panel according to the present invention.

Referring to FIG. 23, the upper panel 21 couples to the top of the open front surface of the cabinet 2, and the upper frame 51 couples to the front surface of the upper panel 21. The control panel 7 couples to the bottom of the upper panel 21.

Specifically, the control panel fastening tab 513 extending from the rear surface at the top of the upper frame 51 is pressed against the rear surface of the upper frame fastening tab 214*a* formed on the upper panel 21. The fastening boss 73 of the control panel 7 is pressed against the front surface of the upper frame fastening tab 214*a*. A screw or similar fastening member is inserted from the rear through to the front of the control panel fastening tab 513.

Accordingly, one fastening member integrally couples the upper panel 21, upper frame 51, and control panel 7, so that assembly is ameliorated and fewer assembly components are used.

Figure 24:
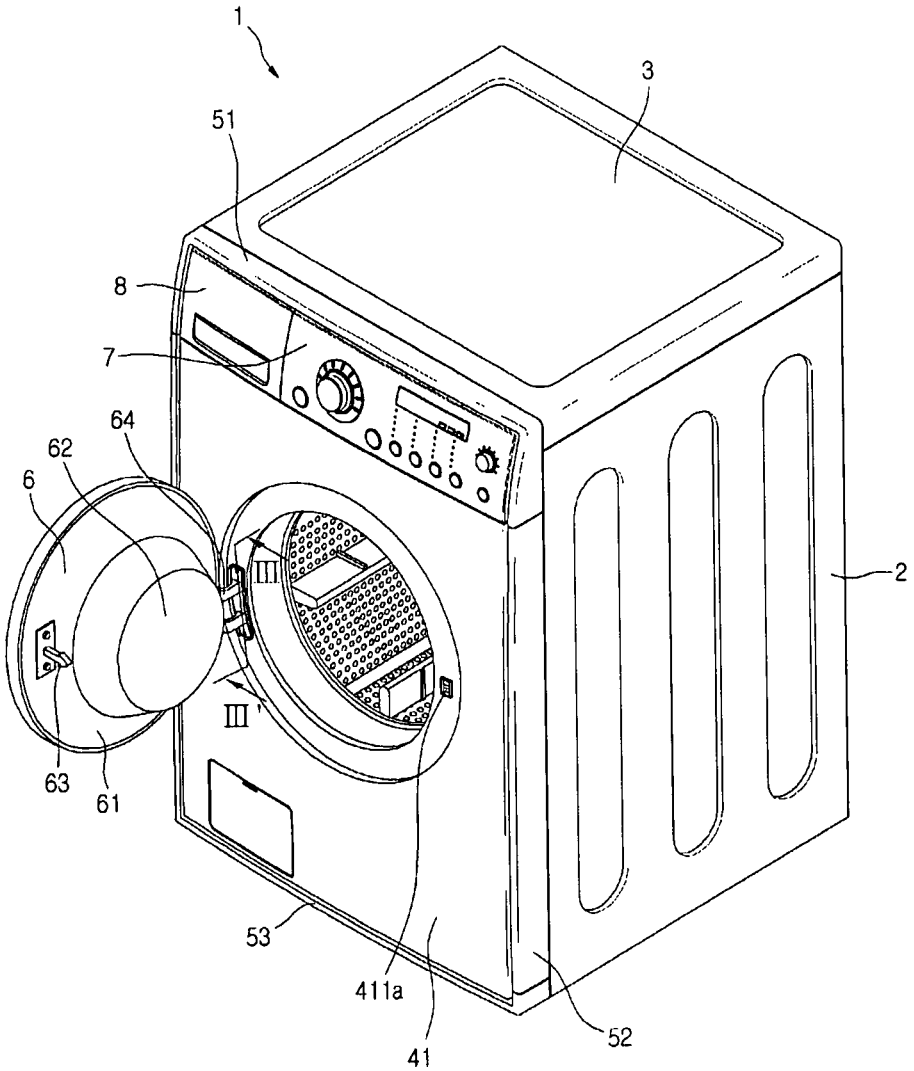
FIG. 24 is a perspective view of a cleaning apparatus according to another embodiment of the present invention.
Figure 25:
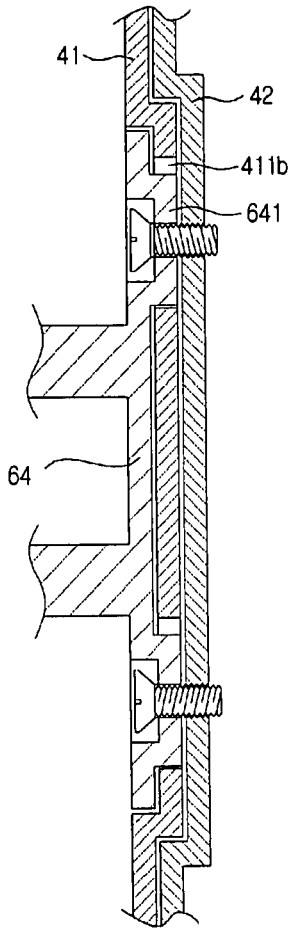
FIG. 25 is a sectional view of the cleaning apparatus in FIG. 24 taken along line III-III'.

FIG. 24 is a perspective view of a cleaning apparatus according to another embodiment of the present invention, and FIG. 25 is a sectional view of the cleaning apparatus in FIG. 24 taken along line III-III'.

Referring to FIGS. 24 and 25, a door 6 is pivotably coupled at the front of the front panel 4 of a cleaning apparatus 1 according to the present invention. The door 6 is formed at roughly the center of the front panel 4 and opens and closes a laundry inserting hole.

In detail, the door 6 includes a door frame 61, a transparent door glass 62 coupled within the door frame 61, a hook 63 protruding from an edge of the door frame 61, and a door hinge 64 coupled on the end opposite to the hook 63.

In further detail, the door hinge 64 is coupled to the recess 411 and 421 of the front panel 4. The hook 63 is inserted into the hook hole 411*a* formed in the recess 411 and 421, and functions to lock the door 6.

The door hinge 64 is firmly coupled to the outer cover 41 and the cabinet cover 42 through the fastening member.

Specifically, the door hinge 64 includes a recessed portion 641 recessed a predetermined depth and spaced a predetermined distance inward from the upper and lower ends thereof. An inserting hole is formed in the recessed portion 641 for inserting a screw or other fastening member therein. The outer cover 41 has a respective receiving hole 411*b* for inserting each recessed portion 641. Thus, the recessed portion 641 is pressed against the cabinet cover 42. A screw or similar fastening member is inserted into the front of the door hinge 64 and passes through the cabinet cover 42. Here, the outer cover 41 prevents the door hinge 64 from moving by means of the receiving hole 411*b*. The door hinge 64 is actually fixed to the cabinet cover 42. In other words, the door hinge 64 is fixed and coupled to the cabinet cover 42 made of a metal plate, and the plastic injection molded outer cover 41 prevents movement thereof. In the above assembly structure, the door 6 is pivotably coupled to the metal cabinet cover 42, and the likelihood of the outer cover 41 being damaged by the opening and closing of the door 6 is reduced.

Below, the order in which the front portion of the cleaning apparatus 1 according to the present invention is assembled will be described step by step.

First Step

First, the outer cover 41 is coupled to the front surface of the cabinet cover 42.

In detail, the upper rib 416 formed on the upper portion of the outer cover 41 is inserted in the upper rib insert hole 426 formed in the upper surface of the cabinet cover 42. In this case, in order to easily insert the upper rib 416 into the upper rib insert hole 426, the process described in FIG. 18 is performed.

The outer cover 41 presses with a predetermined force while against the cabinet cover 42. In this way, the center hook 417 protruding from the rear surface of the outer cover 41 inserts in the center hook insert hole 431 of the cabinet cover 42, and the lower rib 418 protruding from the rear surface at the bottom of the outer cover 41 inserts into the lower rib insert hole 430 formed on the front surface at the bottom of the cabinet cover 42. At the same time, the ends of the plurality of fastening bosses 415 protruding from the rear surface of the outer cover 41 press against the recesses 422 recessed in the front surface of the cabinet cover 42. In this state, a screw or similar fastening member is inserted from the rear of the recesses 422 and screwed into the fastening bosses.

Second Step

In the second step, the side frames 52 are coupled to the sides of the front panel 4.

In detail, the side frame fastening tab 414 formed on the side surface of the outer cover 41 is inserted into the insert recess 528 of the side frame 520. Simultaneously, the frame rib 526 of the side frame 52 is inserted into the frame rib insert hole 413 of the outer frame 41. The frame hook 525 of the side frame 52 is inserted into the frame hook insert hole 423 of the cabinet cover 42.

Third Step

In the third step, with the side frame 52 fastened to the side surface of the front panel 4, the lower frame 53 is coupled to the bottom thereof.

In detail, the respective lower surfaces of the outer and cabinet covers 41 and 42 are pressed against the outer cover mount 532 and the cabinet cover mount 531 formed on the upper portion surface of the lower frame 53. Here, the standing rib 527 extending from the bottom of the side frame 52 is precisely fitted into the standing rib insert slot 534 of the lower frame 53. In this state, a fastening member is inserted into the bolting hole 533 formed in the cabinet cover mount 531, and inserts from the bottom to the top of the lower frame 53. The fastening member is inserted through the bolting hole 427 formed in the bottom of the cabinet cover 42.

Fourth Step

In the fourth step, the front panel 4 assembled in the third step, is installed on the front surface of the cabinet 2.

In detail, the process described in FIG. 17 for coupling the lower portion of the cabinet cover 42 to the lower panel 22 is implemented. The rear surface at the upper portion of the cabinet cover 42 is pressed against the front surface of the upper panel 21. Here, the upper surface of the cabinet cover 42 is pressed against the front surface of the upper panel 21, and then a fastening bolt is used to couple the cabinet cover 42 to the upper panel 21.

Fifth Step

In the fifth step, the upper frame 51 is coupled with the cabinet cover 42, the upper panel 21, and the side frame 52.

In detail, the fixing rib 515 formed at the lower portion of the upper frame 51 is inserted into the fixing rib insert hole 524 formed in the upper surface of the side frame 52. Here, the first and second ribs 516 and 517 protruding from the rear surface of the upper frame 51 insert into the first and second rib insert holes 215 and 216 of the upper panel 21. Then, the fastening hole 512 formed in the cabinet cover fastening tab 511 of the upper frame 51 and the upper frame fastening hole 424*b* of the cabinet cover 42 are aligned. A fastening member is then inserted through the fastening hole 512, the upper frame fastening hole 424*b*, and the upper frame fastening hole 218 formed in the upper panel 21.

Here, in the process of fastening the upper frame 51, the control panel fastening tab 513 protruding from the upper frame 51 is positioned behind the upper frame fastening tab 214*a*.

Sixth Step

In the final step, the control panel 7 is installed to the inside of the upper frame 51.

In detail, the outer cover fixing rib 75 formed at the bottom of the control panel 7 is inserted into the rib insert hole 412 formed in the upper surface of the outer cover 41. When the control panel 7 is pressed, the panel hook 76 inserts into the hook insert hole 213*a* of the upper panel 21. Subsequently, the upper frame fastening boss 73 protruding from the rear surface of the control panel 7 is positioned at the front surface of the upper frame fastening tab 214*a*. A fastening member is used to integrally couple the control panel fastening tab 513, the upper frame fastening tab 214*a*, and the upper frame fastening boss 73.

Here, each component of the fringe frame 5, the outer cover 41, and the cabinet cover 42 are coupled to form the front unit 10. However, the process of forming the front unit 10 and the coupling process of the assembled front unit 10 to the cabinet 2 are not limited to the above-described procedures, and the assembly steps may be changed in order.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

The cleaning apparatus and the fastening method for the front unit of the cleaning apparatus according to the present invention allow a consumer to easily interchange the color of a front unit of a washing machine, dryer, or similar cleaning apparatus, for a high industrial applicability.

The invention claimed is:

1. A cleaning apparatus comprising:

a cabinet opened at a surface thereof;

a cabinet cover installed on a front side of the cabinet, the cabinet cover having a first hole for inserting laundry;

an outer cover coupled to a front surface of the cabinet cover, the outer cover having a second hole located at a site corresponding to the first hole;

a door coupled to the outer cover to selectively close the second hole;

a control panel mounted above the outer cover and provided with an input device; and a fringe frame disposed at a rim of the cabinet cover, the outer cover, and the control panel, the fringe frame comprising:

an upper frame provided with a bent portion to cover an upper and side edges of the control panel; and a side frame coupled to a side surface of the cabinet cover and the outer cover, the side frame comprising:

a frame body extended lengthwise to cover a portion of the cabinet cover, a portion of the outer cover, and a joining portion of the cabinet cover and the outer cover; and a first coupling portion provided at the frame body to be coupled to the cabinet cover; and a second coupling portion provided at the frame body to be coupled to the outer cover, wherein the cabinet cover comprises:

a first guide rib having a first coupling hole into which a first coupling member is inserted to couple the cabinet cover to the cabinet;

a second guide rib having a second coupling hole into which a second coupling member is inserted to couple the cabinet cover to the upper frame and the cabinet; and a rib hole into which a coupling rib of the outer cover is inserted, to couple the cabinet cover to the outer cover.

2. The cleaning apparatus according to claim 1, wherein the outer cover is colored with a paint and is formed of an injection molded plastic capable of withstanding a temperature of at least 60° C.

3. The cleaning apparatus according to claim 2, wherein the paint is a liquid compound of an acrylic base resin mixed with an aluminum powder.

4. The cleaning apparatus according to claim 1, wherein the outer cover includes a front surface that is finished using a super finish treated mold.

5. The cleaning apparatus according to claim 1, wherein the fringe frame further comprises:

a lower frame coupled to a lower portion of the side frame.

6. The cleaning apparatus according to claim 5, wherein the upper, side, and lower frames are connected in one unit.

7. The cleaning apparatus according to claim 5, wherein the side frame further comprise:

a third coupling portion provided at an upper portion of the frame body to be coupled to the upper frame; and a fourth coupling portion provided at a lower portion of the body to be coupled to the lower frame.

8. The cleaning apparatus according to claim 1, wherein the cabinet is open at the side surface thereof, and the cabinet cover and the outer cover are coupled at the open side surface of the cabinet or at an opposite surface thereof.

9. The cleaning apparatus according to claim 1, wherein the cabinet forms a 'n' shape with one side thereof opened, and includes an upper panel coupled at a top of the opened side and a lower panel coupled at a bottom of the opened side, for maintaining the shape of the cabinet.

10. The cleaning apparatus according to claim 9, wherein the cabinet cover is coupled tightly with the lower panel at a lower end thereof and fixed to the upper panel at an upper end thereof.

11. The cleaning apparatus according to claim 9, wherein the control panel is coupled to a front surface of the upper panel.

12. The cleaning apparatus according to claim 1, wherein the cabinet cover comprises a first member provided at a perimeter of the first hole, and the outer cover comprises a second member provided at a perimeter of the second hole and coupled to the first member.

* * * * *